US009016714B2

(12) United States Patent
Pelchat

(10) Patent No.: US 9,016,714 B2
(45) **Date of Patent: *Apr. 28, 2015**

(54) BINDING SYSTEM FOR RECREATIONAL BOARD

(71) Applicant: JF Pelchat Inc., Whistler (CA)

(72) Inventor: Jean-Francois Pelchat, Whistler (CA)

(73) Assignee: JF Pelchat Inc., Whistler (CA)

( * ) Notice: Subject to any disclaimer, the term of this patent is extended or adjusted under 35 U.S.C. 154(b) by 14 days.

This patent is subject to a terminal disclaimer.

(21) Appl. No.: 13/622,920

(22) Filed: Sep. 19, 2012

(65) Prior Publication Data

US 2013/0113184 A1 May 9, 2013

Related U.S. Application Data

(63) Continuation-in-part of application No. 13/318,103, filed as application No. PCT/CA2010/000648 on Apr. 30, 2010, now Pat. No. 8,910,968.

(60) Provisional application No. 61/174,361, filed on Apr. 30, 2009.

(51) Int. Cl.

| | |
|---|---|
| ***A63C 10/26*** | (2012.01) |
| ***A63C 10/16*** | (2012.01) |
| ***A63C 5/03*** | (2006.01) |
| ***A63C 10/00*** | (2012.01) |
| ***A63C 10/04*** | (2012.01) |
| ***A63C 10/28*** | (2012.01) |

(Continued)

(52) U.S. Cl.

CPC . *A63C 10/16* (2013.01); *A63C 5/03* (2013.01); *A63C 10/005* (2013.01); *A63C 10/04* (2013.01); *A63C 10/18* (2013.01); *A63C 10/20* (2013.01); *A63C 10/24* (2013.01); *A63C 10/285* (2013.01)

(58) Field of Classification Search

CPC ..... A63C 5/03; A63C 9/007; A63C 9/16; A63C 10/005; A63C 10/14; A63C 10/145; A63C 10/22; A63C 10/26; A63C 10/28; A63C 10/285

USPC ..... 280/617, 618, 623, 624, 625, 631, 633, 280/14.21, 14.22, 14.24

See application file for complete search history.

(56) References Cited

U.S. PATENT DOCUMENTS

| | | | |
|---|---|---|---|
| 2,593,974 | A | 4/1952 | Brown |
| 2,740,972 | A | 4/1956 | Taylor |

(Continued)

FOREIGN PATENT DOCUMENTS

| | | |
|---|---|---|
| CA | 2247950 | 9/1997 |
| CH | 678278 | 8/1991 |

(Continued)

*Primary Examiner* — Frank Vanaman

(74) *Attorney, Agent, or Firm* — Oyen Wiggs Green & Mutala LLP

(57) ABSTRACT

A binding system for a recreational board is mounted atop a rider-support surface of the board. The binding system comprises: a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board. Each rail comprises at least one deformation-enhancing feature for enhancing an ability of the rail to deform elastically relative to the board.

23 Claims, 18 Drawing Sheets

(51) Int. Cl.

| | |
|---|---|
| *A63C 10/18* | (2012.01) |
| *A63C 10/20* | (2012.01) |
| *A63C 10/24* | (2012.01) |

(56) References Cited

U.S. PATENT DOCUMENTS

| | | | | |
|---|---|---|---|---|
| 2,933,741 | A | 4/1960 | Walter | |
| 3,102,279 | A | 9/1963 | Bennett | |
| 3,127,623 | A | 4/1964 | Roudebush | |
| 3,260,531 | A | 7/1966 | Heuvel | |
| 3,326,564 | A * | 6/1967 | Heuvel | 280/602 |
| 4,728,116 | A | 3/1988 | Hill | |
| 4,871,337 | A | 10/1989 | Harris | |
| 4,896,895 | A | 1/1990 | Bettosini | |
| 5,021,017 | A | 6/1991 | Ott | |
| 5,028,068 | A | 7/1991 | Donovan | |
| 5,044,656 | A | 9/1991 | Peyre | |
| 5,125,680 | A | 6/1992 | Bejean et al. | |
| 5,261,689 | A | 11/1993 | Carpenter et al. | |
| 5,277,635 | A | 1/1994 | Gillis | |
| 5,354,088 | A | 10/1994 | Vetter et al. | |
| 5,356,170 | A | 10/1994 | Carpenter et al. | |
| 5,433,636 | A | 7/1995 | Gillis | |
| 5,499,837 | A | 3/1996 | Hale et al. | |
| 5,553,883 | A | 9/1996 | Erb | |
| 5,558,355 | A | 9/1996 | Henry | |
| 5,577,755 | A | 11/1996 | Metzger et al. | |
| 5,584,492 | A | 12/1996 | Fardie | |
| 5,586,779 | A | 12/1996 | Dawes et al. | |
| 5,660,410 | A | 8/1997 | Alden | |
| 5,667,237 | A | 9/1997 | Lauer | |
| 5,758,895 | A | 6/1998 | Bumgarner | |
| 5,813,688 | A * | 9/1998 | Dacklin | 280/607 |
| 5,826,910 | A | 10/1998 | Ricks et al. | |
| 5,855,390 | A * | 1/1999 | Hassell | 280/607 |
| 5,899,483 | A | 5/1999 | Paris | |
| 5,901,975 | A | 5/1999 | Phipps | |
| 5,909,893 | A | 6/1999 | Keller et al. | |
| 5,915,718 | A | 6/1999 | Dodge | |
| 5,947,488 | A | 9/1999 | Gorza et al. | |
| 5,947,508 | A | 9/1999 | Graf et al. | |
| 5,967,531 | A | 10/1999 | Saillet | |
| 5,967,542 | A | 10/1999 | Williams et al. | |
| 5,975,557 | A | 11/1999 | Snoke et al. | |
| 5,984,346 | A | 11/1999 | Keller | |
| 6,015,161 | A | 1/2000 | Carlson | |
| 6,062,584 | A | 5/2000 | Sabol | |
| 6,082,026 | A | 7/2000 | Sand et al. | |
| 6,089,581 | A | 7/2000 | Partridge | |
| 6,099,018 | A | 8/2000 | Maravetz et al. | |
| 6,155,578 | A | 12/2000 | Patterson | |
| 6,189,899 | B1 | 2/2001 | Carlson | |
| 6,189,911 | B1 | 2/2001 | Caron et al. | |
| 6,203,051 | B1 | 3/2001 | Sabol | |
| 6,302,428 | B1 | 10/2001 | Jungkind | |
| 6,336,650 | B1 | 1/2002 | Alspaugh | |
| 6,382,641 | B2 | 5/2002 | Dennis et al. | |
| 6,390,492 | B1 | 5/2002 | Bumgarner et al. | |
| 6,428,032 | B1 | 8/2002 | Humbel | |
| 6,457,736 | B1 | 10/2002 | Maravetz et al. | |
| 6,485,035 | B1 | 11/2002 | Laughlin et al. | |
| 6,491,310 | B1 | 12/2002 | Work | |
| 6,523,851 | B1 | 2/2003 | Maravetz | |
| 6,581,944 | B1 | 6/2003 | Marmonier et al. | |
| 6,631,919 | B1 | 10/2003 | West et al. | |
| 6,736,413 | B2 | 5/2004 | Laughlin et al. | |
| 6,789,806 | B2 | 9/2004 | Santa Cruz et al. | |
| 6,945,544 | B2 | 9/2005 | Feurer et al. | |
| 7,063,346 | B2 | 6/2006 | Elkington | |
| 7,077,403 | B2 | 7/2006 | Laughlin et al. | |
| 7,097,195 | B2 | 8/2006 | Orr et al. | |
| 7,204,495 | B2 | 4/2007 | Reuss et al. | |
| 7,566,062 | B2 | 7/2009 | Reuss et al. | |
| 7,748,729 | B2 | 7/2010 | Laughlin et al. | |
| 7,992,888 | B2 | 8/2011 | Steere | |
| 2001/0038182 | A1 | 11/2001 | Carlson | |
| 2002/0185840 | A1 | 12/2002 | Schaller et al. | |
| 2002/0185841 | A1 | 12/2002 | Schaller et al. | |
| 2003/0011171 | A1 | 1/2003 | Battistella | |
| 2003/0042709 | A1 | 3/2003 | Dodge | |
| 2003/0094790 | A1 * | 5/2003 | Poscich | 280/618 |
| 2003/0116931 | A1 | 6/2003 | Quattro et al. | |
| 2003/0178812 | A1 | 9/2003 | Schaller et al. | |
| 2003/0189316 | A1 | 10/2003 | Schaller et al. | |
| 2003/0209881 | A1 | 11/2003 | Krumbeck et al. | |
| 2003/0230870 | A1 | 12/2003 | Sabol | |
| 2004/0017064 | A1 | 1/2004 | Brown et al. | |
| 2004/0150194 | A1 | 8/2004 | Okajima | |
| 2005/0167933 | A1 | 8/2005 | Couderc | |
| 2005/0248129 | A1 | 11/2005 | Pelchat | |
| 2007/0114737 | A1 * | 5/2007 | Lindemann | 280/14.23 |
| 2010/0295269 | A1 | 11/2010 | Krenn et al. | |

FOREIGN PATENT DOCUMENTS

| | | |
|---|---|---|
| EP | 0351298 | 1/1990 |
| EP | 0612546 | 8/1994 |
| EP | 1741474 | 1/2007 |
| FR | 2715861 | 8/1995 |
| WO | 9703733 | 2/1997 |
| WO | 02053240 | 7/2002 |
| WO | 02076561 | 10/2002 |

* cited by examiner 90
12
88
166A
44A
20A
42A, 18
26A
14
12
to toe edge 24B
64A
19C
10
21
19A
to heel edge 24A
62A 92
12
88
166A
44A
20A
42A, 18
26A
14, 24
64A
to heel edge 24A
19A
62A
21
19C
10
to toe edge 24B

BINDING SYSTEM FOR RECREATIONAL BOARD

RELATED APPLICATIONS

This application is a continuation-in-part of U.S. patent application Ser. No. 13/318,103 having a 35 USC §371 date of 28 Oct. 2011, which is a national phase entry application under 35 USC §371 of Patent Cooperation Treaty Application No. PCT/CA2010/000648 filed 30 Apr. 2010 which in turn claims priority from, and the benefit under 35 U.S.C. §119 of, U.S. Patent Application No. 61/174,361 filed 30 Apr. 2009. All of the aforementioned applications are hereby incorporated herein by reference.

TECHNICAL FIELD

The invention relates to the field of recreational sports where an individual stands on a rider-support surface of a board and rides the board through or atop of a medium such as air, snow or water. Particular embodiments provide binding systems which may be used to retain the individuals feet atop the rider-support surface.

SUMMARY

Many recreational sports, such as snowboarding, for example, involve riding a board through or atop of a medium such as air, snow or water. A rider stands on one surface (the rider-support surface) of an elongated snowboard with his or her feet spaced apart from one another and oriented at various angles oriented generally transversely with respect to the longitudinal axis of the snowboard. The rider rides the board down snow covered inclined slopes in directions generally aligned with the longitudinal axis of the board with one foot in front of the other in a manner similar to that of surfing. Because of the transverse orientation of the rider's feet with respect to the longitudinal axis of the board, depending on whether the rider puts their right foot forward or their left foot forward, the rider's stance defines one edge of the snowboard to be the "heel side" or "heel edge" (i.e. the edge of the board closest to the rider's heels) and the transversely opposite edge of the snowboard to be the "toe side" or "toe edge" (i.e. the edge of the board closest to the rider's toes).

Snowboards typically incorporate bindings which may increase the rider's control over the board. Bindings typically retain the rider's feet in their generally transverse orientations atop the rider-support surface of the board and assist the rider to transfer his or her weight between the toe and heel edges of the board and to thereby assist the rider to turn the board. There are many types of prior art snowboard bindings. Most prior art bindings incorporate a binding base plate or the like which is located on the rider-support surface of the board and is rigidly mounted to the board. The most common type of binding, typically referred to as a "high back" binding, incorporates a back member which projects from the binding base plate on the rider-support surface, such that the rider may lean toward their heel edge (e.g. against the back member) to apply pressure to the heel edge of the board, and one or more straps which extend over top of the foot and bind the foot to the binding base plate, such that the rider may lean toward their toe edge (e.g. against the straps) to apply pressure to the toe side of the board. Another common type of binding, referred to as the "step-in" binding, typically requires that the rider wear a hard shell boot which is secured to the binding base plate, such that the rider can apply pressure to the heel and toe edges of the snowboard by applying corresponding pressure against the interior surfaces of their hard shell boots. Step-in bindings use a variety of techniques for securing the hard shell boot to the binding base plate.

There is a general desire to improve the performance of prior art binding systems and/or to provide binding systems which offer new features over those of the prior art.

SUMMARY OF THE INVENTION

Aspects of this invention provide binding systems for recreational boards. Particular aspects of the invention are suitable for snowboard type recreational boards.

In one aspect, a binding system is mountable atop a rider-support surface of the board. In some embodiments, at least a portion of the binding system is moveable (e.g. pivotal, tiltable, etc.) with the rider's foot and with respect to the board. This relative motion between the rider's foot and the board may be associated with movement (e.g. pivoting, tilting and/or the like) of the rider's foot toward the heel edge or toward the toe edge of the board and may thereby allow the rider to have greater control over the application of weight to the heel and/or toe edges of the board.

In particular embodiments, the binding system comprises: a base rigidly mounted or mountable atop a rider-support surface of the board; and a foot-retainer for retaining the rider's foot in generally fixed relation thereto. The foot-retainer is coupled or coupleable to the base via one or more movement joints (e.g. pivot couplings) for motion (e.g. pivotal motion) of the foot-retainer and the rider's foot relative to the base and/or the board. The binding may be configured to receiver the rider's foot (or footwear) with the rider's toes on one side of a longitudinal axis of the board and the rider's heel on the other side of the longitudinal axis. In some embodiments, the rider's foot may be received on a generally flattened foot-receiving surface of the base. In some embodiments, the binding is provided in a baseless configuration where the foot-receiving surface is provided by the generally flattened rider-support surface of the board itself.

In some embodiments, the movement joints comprise pivot couplings configured for pivotal motion about a pivot axis. The pivot axis may be located in a pivot plane which is spaced upwardly apart from and generally parallel to the generally flattened foot-receiving surface. In this manner, the pivot axis is located above the bottom of the rider's foot, whether the foot-receiving surface is part of the base or the foot-receiving surface is provided by the rider support surface of the board itself. In some embodiments, the base comprises one or more stand-off flanges, each stand-off flange shaped to locate a corresponding one of the pivot couplings at a location spaced upwardly apart from the foot-receiving surface. In some embodiments, the base comprises a front stand-off flange and a rear stand-off flange, the front stand-off flange shaped to locate a corresponding front pivot coupling at a front pivot location forward of the foot-receiving surface and spaced upwardly apart from the foot-receiving surface and the rear stand-off flange shaped to locate a corresponding rear pivot coupling at a rear pivot location rearward of the foot-receiving surface and spaced upwardly apart from the foot-receiving surface.

In some embodiments, the base comprises a front stand-off flange and a rear stand-off flange, the front stand-off flange shaped to locate a corresponding front movement joint at a front joint location forward of the foot-receiving surface and the rear stand-off flange shaped to locate a corresponding rear movement joint at a rear joint location rearward of the foot-receiving surface. The front and rear joint locations may be spaced upwardly apart from a foot-receiving surface provided by the base. The front and rear joint locations may be spaced upwardly apart from a foot-receiving surface provided by a rider support surface of the board. The base may optionally comprise a front mounting flange that projects longitudinally from the front stand-off flange and a rear mounting flange that projects longitudinally from the rear stand-off flange. The front mounting flange may project forwardly from the front stand-off flange and the rear mounting flange may project rearwardly from the rear stand-off flange. The front and rear mounting flanges may be shaped to abut against a rider-support surface of the recreational board and may be apertured for projection of fasteners therethrough to mount the binding to the recreational board.

In some embodiments, the foot-retainer comprises a front rail located forwardly of the foot-receiving surface and a rear rail located rearwardly of the foot-receiving surface for receiving the rider's foot therebetween. Each of the front and rear rails may comprise a pair of legs (i.e. a toe-side leg and a heel-side leg) and a central portion located between the pair of legs. The lower edge of each rail may have a downwardly opening concave profile, such that the legs extend downwardly from the central portion. The pair of legs of each rail may extend downwardly to contact the board or to contact deformable pads interposed between the legs and the board, such that the central portion is spaced upwardly apart from the rider-support surface of the board. In some embodiments, the rails may be shaped such that their central portions are spaced upwardly apart from the foot-receiving surface.

Movement joints between the foot-retainer and the base may be located (at least in part) in the central portions of the rails and may be provided between the central portions of the rails and respective ones of the front and rear stand-off flanges. In the embodiments where the movement joints comprise pivot couplings, the pivot couplings may be located (at least in part) in the central portions of the rails and may be provided between the central portions of the rails and respective ones of the front and rear stand-off flanges. The front and rear rails may be apertured with apertures elongated in a transverse direction for adjustability of transverse locations of the front and rear rails relative to the front and rear stand-off flanges and the front and rear movement joints and/or pivot couplings. The apertures of the front and rear rails may comprise transversely spaced apart concavities between vertically extending projections for supporting the front and rear pivot couplings within the transversely spaced apart concavities.

The binding system may optionally comprise one or more deformable pads which may be located at points of contact between the foot-retainer and the board and/or at points of contact between the foot and the board. Such pads may be elastically deformable with corresponding movement of the foot-retainer and the rider's foot. The deformable pads may comprise: one or more toe-side deformable pads located below lowermost portions of the toe-side legs of the front and rear rails and located on a toe-side of the longitudinal axis of the board; and one or more heel-side deformable pads located below lowermost portion of the heel-side legs of the front and rear rails and located on a heel-side of the longitudinal axis of the board, the heel-side of the longitudinal axis transversely opposed to the toe-side of the longitudinal axis. Pivotal motion of the foot-retainer relative to the base and the recreational board in a first angular direction causes compression of the one or more toe-side deformable pads and pivotal motion of the foot-retainer relative to the base and the recreational board in an opposing angular direction causes compression of the one or more heel-side deformable pads. The one or more toe-side deformable pads and the one or more heel-side deformable pads may be elastically deformable such that when compressed, they exhibit restorative forces which tend to restore them to their non-compressed shapes.

In some embodiments, the foot-retainer may comprise a heel cup which extends longitudinally between the front and rear rails on a heel side of the binding, the heel cup comprising a concave surface shaped to accommodate a portion of a heel of the rider's foot. In some embodiments, the foot-retainer may comprise: a high-back located on the heel-side of the binding. The high-back may extend upwardly from the heel cup. The high-back may additionally or alternatively extend between and upwardly from the front and rear rails. The high-back may comprise a concave surface shaped to accommodate an upper portion of the heel of the rider's foot; and a strapping system extending longitudinally between one or more of: the front and rear rails, front and rear portions of the heel cup and front and rear portions of the high back, the strapping system adjustable to a first configuration where the rider's foot is retained under the strapping system and against the concave surface of the high back so as to be generally fixed in relation to the foot-retainer and to a second configuration wherein the rider's foot is insertable into and removable from the foot-retainer.

The base may provide the generally flattened foot-receiving surface as an upper surface of a base plate shaped to abut against a rider-support surface of the recreational board. The base plate may extend longitudinally between the front stand-off flange and the rear stand-off flange. The base plate may comprise one or more apertures through which one or more fasteners may extend to mount the base plate to the recreational board. The base plate may comprise: a generally circularly shaped cut-out having an annular region of upwardly facing, radially extending ridges around a perimeter thereof; and a generally circularly shaped mounting disc having an annular region of downwardly facing, radially extending ridges inside a perimeter thereof, the downwardly facing ridges of the mounting disc shaped to engage the upwardly facing ridges in the annular region around the perimeter of the cut-out. The mounting disc may be apertured for projection of one or more fasteners therethrough to mount the binding to the recreational board. The front and rear stand-off flanges may be one of: integrally formed with the base plate; rigidly coupled to the base plate; rigidly coupleable to the base plate.

In embodiments, where the movement joints comprise pivot couplings, the front pivot coupling may comprise a front pivot pin that is generally circular in cross-section such that pivotal motion of the foot-retainer relative to the base and to the board is associated with one or more of: relative motion between the front rail and the front pivot pin; and relative motion between the front stand-off flange and the front pivot pin; and the rear pivot coupling may comprise a rear pivot pin that is generally circular in cross-section such that pivotal motion of the foot-retainer relative to the base and to the board is associated with one or more of: relative motion between the rear rail and the rear pivot pin; and relative motion between the rear stand-off flange and the rear pivot pin. In embodiments, where the movement joints comprise pivot couplings, the front pivot coupling may comprise a front pivot joint between a first front pivot coupling component fixed relative to the front rail and a second front pivot coupling component fixed relative to the front stand-off flange, such that pivotal motion of the foot-retainer relative to the base and to the board is associated with relative motion of the first and second front pivot coupling components; and the rear pivot coupling may comprise a rear pivot joint between a first rear pivot coupling component fixed relative to the rear rail and a second rear pivot coupling component fixed relative to the rear stand-off flange, such that pivotal motion of the foot-retainer relative to the base and to the board is associated with relative motion of the first and second rear pivot coupling components. The front and rear pivot couplings may be located in range of 0.5 cm-10 cm from the lowermost part of the binding. The front and rear pivot couplings may be located in range of 0.5 cm-10 cm from the foot-receiving surface.

In some embodiments, the one or more movement joints each comprise a shaft that extends between the foot-retainer and the base and motion of the foot-retainer and the rider's foot relative to the base and the recreational board is associated with corresponding movement of the shaft. In some embodiments, the shaft may be the shaft of a pivot coupling. For each of the one or more movement joints, the shaft may extend through a bore of each of one or more deformable bushings. For each of the one or more movement joints, at least one of the one or more bushings may extend between the foot-retainer and the base. For each of the one or more movement joints, at least one of the one or more bushings may be located on a side of the base opposite that of the foot-retainer. For each of the one or more movement joints, at least one of the one or more bushings may be located on a side of the foot-retainer opposite that of the base. The shaft may extend in a plane generally parallel to a rider-support surface of the recreational board in an absence of forces applied by the rider. The shaft may extend generally vertically between the foot-retainer and the base in an absence of forces applied by the rider. In some embodiments, the one or more movement joints each comprise a plurality of shafts that extend between the foot-retainer and the base and motion of the foot-retainer and the rider's foot relative to the base and the recreational board is associated with corresponding movement of the plurality of shafts.

Another aspect of the invention provides a binding system for retaining a rider's foot atop a recreational board. The binding system comprises a pair of rails locatable on opposing sides of a generally flattened foot-receiving surface for receiving a rider's foot. Each rail comprising a central portion mountable to the recreational board, a toe-side leg which extends from the central portion toward a toe-side of the recreational board and a heel-side leg which extends from the central portion toward a heel-side of the recreational board. The heel-side and the toe-side are located on transversely opposite sides of a longitudinal axis of the board. Each rail comprises at least one deformation-enhancing feature for enhancing an ability of the rail to deform elastically relative to the board.

The at least one deformation-enhancing feature may enhance an ability of at least one of the toe-side leg and the heel-side leg to deform elastically relative to the central portion. For the at least one of the rails, the at least one deformation-enhancing feature may comprise a heel-side deformation-enhancing feature located between the heel-side leg and the central portion for enhancing an ability of the heel-side leg to deform elastically relative to the central portion. For the at least one of the rails, the at least one deformation-enhancing feature may comprise a toe-side deformation-enhancing feature located between the toe-side leg and the central portion for enhancing an ability of the toe-side leg to deform elastically relative to the central portion.

For the at least one of the rails, the heel-side deformation-enhancing feature may comprise a heel-side cut-away slot which extends inwardly from an edge of the at least one of the rails between the heel-side leg and the central portion. The slot may be shaped to provide an opening located at an end of the slot most proximate the edge of the at least one of the rails and elastic deformation of the heel-side leg relative to the central portion may comprise at least one of increasing a size of the opening and decreasing the size of the opening. The slot may be shaped to provide the opening at a lower edge of the at least one of the rails. The slot may be shaped to provide the opening at an upper edge of the at least one of the rails.

For the at least one of the rails, the toe-side deformation-enhancing feature may comprise a toe-side cut-away slot which extends inwardly from an edge of the at least one of the rails between the toe-side leg and the central portion. The slot may be shaped to provide an opening located at an end of the slot most proximate the edge of the at least one of the rails and elastic deformation of the toe-side leg relative to the central portion may comprise at least one of increasing a size of the opening and decreasing the size of the opening. The slot may be shaped to provide the opening at a lower edge of the at least one of the rails. The slot may be shaped to provide the opening at an upper edge of the at least one of the rails.

For the at least one of the rails, the heel-side deformation-enhancing feature may comprise a heel-side deformation member, the heel-side deformation member relatively more deformable than the heel-side leg and the central portion. In some embodiments, the heel side deformation member may be fabricated from a material relatively more deformable than the heel side leg and the central portion. In some embodiments, the heel side deformation member may comprise a lower density of reinforcing ribs than the heel side leg and the central portion. For the at least one of the rails, the toe-side deformation-enhancing feature may comprise a toe-side deformation member, the toe-side deformation member relatively more deformable than the toe-side leg and the central portion. In some embodiments, the toe side deformation member may be fabricated from a material relatively more deformable than the toe side leg and the central portion. In some embodiments, the toe side deformation member may comprise a lower density of reinforcing ribs than the toe side leg and the central portion.

For the at least one of the rails, the at least one deformation-enhancing feature may comprise the heel-side leg being relatively more deformable than the central portion. In some embodiments, the central portion comprises a plurality of stiffening ribs and the heel-side leg comprises a lower density of stiffening ribs relative to the central portion, thereby making the heel-side leg relatively more deformable than the central portion. In some embodiments, the heel-side leg is fabricated from a material that is relatively more deformable than the central portion. For the at least one of the rails, the at least one deformation-enhancing feature may comprise the toe-side leg being relatively more deformable than the central portion. In some embodiments, the central portion comprises a plurality of stiffening ribs and the toe-side leg comprises a lower density of stiffening ribs relative to the central portion, thereby making the toe-side leg relatively more deformable than the central portion. In some embodiments, the toe-side leg is fabricated from a material that is relatively more deformable than the central portion.

Another aspect of the invention provides a binding system for retaining a rider's foot atop a recreational board, where the binding system comprises: a base mountable to the recreational board, the base comprising a front stand-off flange located forwardly of a generally flattened foot-receiving surface for receiving a rider's foot and a rear stand-off flange located rearwardly of the foot-receiving surface; and a foot retainer for retaining the rider's foot in generally fixed relation thereto, the foot-retainer comprising a front rail located forwardly of the foot-receiving surface and connected to the front stand-off flange at one or more front connections and a rear rail located rearwardly of the foot-receiving surface and connected to the rear stand-off flange at one or more rear connections. Either: (a) the front rail is relatively more deformable than the front stand-off flange and the rear rail is relatively more deformable than the rear stand-off flange for motion of the rider's foot relative to the recreational board by deformation of one or both of the front and rear rails; or (b) the front standoff flange is relatively more deformable than the front rail and the rear stand-off flange is relatively more deformable than the rear rail for motion of the rider's foot relative to the recreational board by deformation of one or both of the front and rear stand-off flanges.

In some embodiments, each of the front connections comprises a shaft that extends between the front rail and the front stand-off flange and motion of the rider's foot relative to the recreational board is associated with corresponding movement of the shaft. In some embodiments, the shaft extends through a bore of one or more deformable bushings, the one or more deformable bushings more deformable than both the front stand-off flange and the front rail. In some embodiments, each of the rear connections comprises a shaft that extends between the rear rail and the rear stand-off flange and motion of the rider's foot relative to the recreational board is associated with corresponding movement of the shaft. In some embodiments, the shaft extends through a bore of one or more deformable bushings, the one or more deformable bushings more deformable than both the rear stand-off flange and the rear rail.

In some embodiments, the relative deformability of the rails and the stand-off flanges may be provided by fabricating the rails and stand-off flanges from different materials, fabricating the rails and stand-off flanges to have different component thicknesses and/or fabricating the rails and stand-off flanges to have different rigidity-enhancing features, such as rib densities.

Another aspect of the invention provides a recreational board (e.g. a snowboard) which comprises a pair of bindings mounted thereto, the bindings incorporating any of the features, combinations or sub-combinations of features of the binding systems described herein.

Another aspect of the invention provides s kit comprising a recreational board (e.g. a snowboard) and a pair of bindings mountable to the board, the bindings incorporating any of the features, combinations or sub-combinations of features of the binding systems described herein.

Another aspect of the invention provides methods for riding a recreational board, the methods providing at least one binding incorporating any of the features, combinations or sub-combinations of features of the binding systems described herein and exerting force against a part of the binding (e.g. the foot-retainer) to cause a portion of the binding and the rider's foot to move relative to the board.

Other aspects provide methods of operating, manufacturing and/or assembling binding systems for recreational boards wherein at least a portion of the binding system is movable with the rider's foot and with respect to the board.

Further features and applications of specific embodiments of the invention are described below.

BRIEF DESCRIPTION OF THE DRAWINGS

In drawings which depict non-limiting embodiments of the invention.

DETAILED DESCRIPTION

Figure 1:
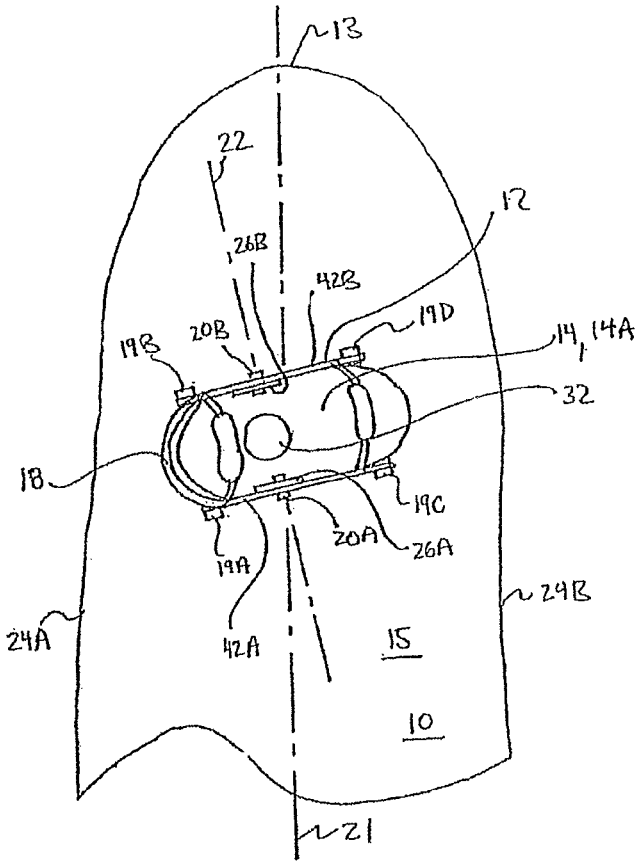
FIG. 1 is a top view of a portion of a recreational board and a binding system according to a particular embodiment of the invention.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

Aspects of this invention provide binding systems for recreational boards. The binding system is mounted atop a rider-support surface of the board. In some embodiments, at least a portion of the binding system is moveable (e.g. pivotal, tiltable, etc.) with the rider's foot and with respect to the board. This relative motion may allow the rider to move their foot relative to the base and/or the board in a manner which directs relatively more of the forces associated with rider's weight and/or other forces exerted by the rider onto one of the heel and/or the toe edge. For example, such forces may be transferred by moving their foot (e.g. pivoting their foot about a pivot axis) relatively close to the heel edge or relatively close to the toe edge. Such relative movement of the rider's foot may in turn allow the rider to have greater control over the application of such forces to the heel and/or toe edges of the board. In particular embodiments, the binding system comprises: a base rigidly mounted atop rider-support surface of the board and having a foot-receiving surface for receiving the rider's foot thereatop; and a foot-retainer for retaining the rider's foot in generally fixed relation thereto. When the rider's foot is received atop the foot-receiving surface of the base and is retained by the foot-retainer, the rider's foot (or footwear) is retained with the rider's toes on one transverse side of a longitudinal axis of the board and the rider's heel is retained on an opposing transverse side of the longitudinal axis. The foot retainer is mounted or mountable to the base via one or more movement joints (e.g. pivot couplings) for motion of the foot-retainer relative to the base and/or the board such that the rider's foot can move (e.g. pivot) relatively close to the heel edge of the board or relatively close to the toe edge of the board.

In some embodiments, the movement joints between the foot retainer and the base are located above the foot-receiving surface of the base. In the case of pivot joints, for example, the pivot axis about which the pivot joints are configured to pivot may be located above the foot-receiving surface of the base. In some embodiments, a base is not necessary and the rider's foot is received directly atop the rider-support surface of the board (i.e. the rider-support surface of the board also provides the foot-receiving surface). In such embodiments, movement joints may be provided between the foot retainer and a pair of standoff flanges. In such embodiments, the movement joints (e.g. the pivot axes of pivot joints) may be located above the rider-support surface of the board.

In some embodiments, each binding comprises a front movement joint (e.g. a front pivot joint) that is located forwardly of the rider's foot (e.g. forwardly of the rider's forward ankle) when the rider's foot is retained in the binding and a rear movement joint (e.g. a rear pivot joint) that is located rearwardly of the rider's foot (e.g. rearwardly of the rider's rearward ankle) when the rider's foot is retained in the binding. The binding system may optionally comprise one or more deformable pads which may be located at points of contact between the foot-retainer and the board and/or at points of contact between the foot and the board. Such pads may be elastically deformable with corresponding movement of the foot-retainer. In some embodiments, the movement joints between the foot-retainer and the base may comprise deformable bushings, bias mechanisms or the like to dampen or otherwise cushion the relative motion between the foot-retainer and the base. Such bushings may be elastically deformable.

Some embodiments of the invention provide a binding system which comprises a pair of rails locatable on opposing sides of a generally flattened foot-receiving surface for receiving a rider's foot. Each rail comprising a central portion mountable to the recreational board, a toe-side leg which extends from the central portion toward a toe-side of the recreational board and a heel-side leg which extends from the central portion toward a heel-side of the recreational board. The heel-side and the toe-side are located on transversely opposite sides of a longitudinal axis of the board. Each rail comprises at least one deformation-enhancing feature for enhancing an ability of the rail to deform elastically relative to the board.

Some embodiments of the invention provide a binding system for retaining a rider's foot atop a recreational board, where the binding system comprises: a base mountable to the recreational board, the base comprising a front stand-off flange located forwardly of a generally flattened foot-receiving surface for receiving a rider's foot and a rear stand-off flange located rearwardly of the foot-receiving surface; and a foot retainer for retaining the rider's foot in generally fixed relation thereto, the foot-retainer comprising a front rail located forwardly of the foot-receiving surface and connected to the front stand-off flange at one or more front connections and a rear rail located rearwardly of the foot-receiving surface and connected to the rear stand-off flange at one or more rear connections. Either: (a) the front rail is relatively more deformable than the front stand-off flange and the rear rail is relatively more deformable than the rear stand-off flange for motion of the rider's foot relative to the recreational board by deformation of one or both of the front and rear rails; or (b) the front standoff flange is relatively more deformable than the front rail and the rear stand-off flange is relatively more deformable than the rear rail for motion of the rider's foot relative to the recreational board by deformation of one or both of the front and rear stand-off flanges.

FIG. 1 is a top view of the front portion of a recreational board 10 and a portion of a binding system 12 according to a particular embodiment. Recreational board 10 may be a snowboard or some other type of recreational board. Binding system 12 is mounted (or mountable) atop rider-support surface 15 of board 10. FIG. 1 shows only a front binding system 12 (i.e. the binding closest to the front 13 of board 10). Those skilled in the art will appreciate that snowboards and similar recreational boards typically comprise a pair of bindings and that the rear binding system may be generally similar to front binding system 12. Board 10 is generally designed to be ridden in directions aligned with its longitudinal axis 21 such that one of the rider's feet (and a corresponding one of the bindings) leads the other foot (and the other binding) in the direction of motion.

Binding system 12 of the illustrated embodiment comprises: a base 14, which may be rigidly mounted to board 10 atop rider-support surface 15 of board 10 and which comprises a foot-receiving surface 14A for receiving the rider's foot thereatop; and a foot-retainer 18 for retaining the rider's foot in generally fixed relation thereto such that the rider's foot (or footwear) is retained atop foot-receiving surface 14A with the rider's toes retained on one transverse side of a longitudinal axis 21 of board 10 and the rider's heel retained on the opposing transverse side of longitudinal axis 21. The transverse edge of board 10 closest to the rider's heel may be referred to as heel edge 24A of board 10 and the transverse edge of board 10 closest to the riders toes may be referred to as toe edge 24A of board 10. As mentioned above, board 10 is generally designed to be ridden in directions aligned with its longitudinal axis 21. In the FIG. 1 configuration, the rider's left foot is leading their right foot such that heel edge 24A is on the left side of the illustrated view and toe edge 24B is on the right side of the illustrated view. This configuration is conventionally referred to as "regular foot". In some configurations (not shown), the rider's right foot leads their left foot, so that: the rider's heel is on the right side of longitudinal axis 21 and the heel edge is on the right side of the board (when viewed from the top); and the rider's toes are on the left side of longitudinal axis 21 and the toe-edge is on the right side of the board (when viewed from the top). This configuration is conventionally referred to as "goofy foot". Embodiments of the invention may be implemented in regular foot or goofy foot configurations.

Foot-retainer 18 is moveably mounted to base 14 at movement joints 20A, 20B (collectively, movement joints 20) for motion of foot-retainer 18 relative to base 14 and/or board 10. In the FIG. 1 embodiment, foot-retainer 18 is pivotally mounted to base 14 and movement joints 20 comprise pivot couplings which facilitate pivotal motion of foot-retainer 8 relative to base 14 and/or board 10 about pivot axis 22. For this reason, movement joints 20 of binding 12 (portions of which are shown in FIGS. 1-5B) may be referred herein as pivot couplings 20 and the relative motion between foot-retainer 18 and base 14 may be referred to as pivotal motion, without loss of generality. In other embodiments, movement joints 20 may facilitate other types of relative movement, as described in more detail below. Foot-retainer 18 may retain a rider's foot (e.g. in a generally fixed relation to foot-retainer 18) such that the rider's foot moves (e.g. pivots, tilts, etc.) with foot-retainer 18 relative to base 14 and/or board 10. Binding system 12 may optionally comprise one or more deformable pads 19A, 19B, 19C, 19D (collectively, pads 19) which may be located at points of contact between foot-retainer 18 and board 10. Such pads 19 may be elastically deformable and may deform with corresponding movement of foot-retainer 18.

In the illustrated embodiment, where movement joints 20 comprise pivot couplings, the riders foot may pivot with foot-retainer 18 about pivot axis 22. The motion of foot-retainer 18 and the corresponding motion of the rider's foot with respect to board 10 and/or base 14 may move their foot relative to the base and/or the board in a manner which directs relatively more of the forces associated with rider's weight and/or other forces exerted by the rider onto one of heel edge 24A and/or toe edge 24B of board 10. For example, such forces may be transferred by moving their foot (e.g. pivoting their foot about pivot axis 22) relatively close to heel edge 24A or relatively close to toe edge 24B. Such relative movement of the rider's foot may in turn allow the rider greater control over the transfer of weight to heel edge 24A and/or to toe edge 24B (collectively, edges 24) of board 10. By way of non-limiting example, in comparison to rigidly mounted (i.e. non-moveable) bindings, the motion of foot-retainer 18 may provide a rider with increased control by allowing the rider to increase the amount of force/weight transferred to edge(s) 24, to decrease the amount of effort required to transfer a given amount of force/weight to edge(s) 24 or the like. This greater control in turn provides greater rider comfort ad/or less fatigue.

This description and the accompanying claims use a number of directional conventions to clarify their meaning:

(i) "front", "forward", "forwadly", "forwardmost" and similar words are used to refer to directions that are generally oriented towards the front 13 of board 10 (FIG. 1);

(ii) "back", "backward", "rear", "rearward", "rearwardly", "rearwardmost" and similar words are used to refer to directions that are generally oriented away from the front 13 of board 10 (i.e. opposite the forward direction);

(iii) "longitudinal" and "longitudinally" and similar words are used to refer to either or both of the forward and rearward directions;

(iv) "transverse", "transversely" and similar words refer to directions that are generally orthogonal to the longitudinal direction and generally in the plane of snowboard 10 (e.g. toward either or both of heel edge 24A and toe edge 24B);

(v) "up", "upper", "upward", "upwardly", "upwardmost" and similar words are used to refer to a direction that extends from a center of board 10 towards rider-support surface 15 and beyond (i.e. out of the page toward the reader in FIG. 1);

(vi) "low", "lower", "down", "downward", "downwardly", "downwardmost" and similar words refer to a direction that is opposite the upward direction; and (vii) "vertical", "vertically" or similar words refer to either or both of the upward and downward directions.

Those skilled in the art will appreciate that directional conventions used in this description and the accompanying claims depend on the specific orientation of board 10 and binding system 12. Accordingly, these directional terms are not strictly defined and should not be interpreted narrowly.

Figure 2A:
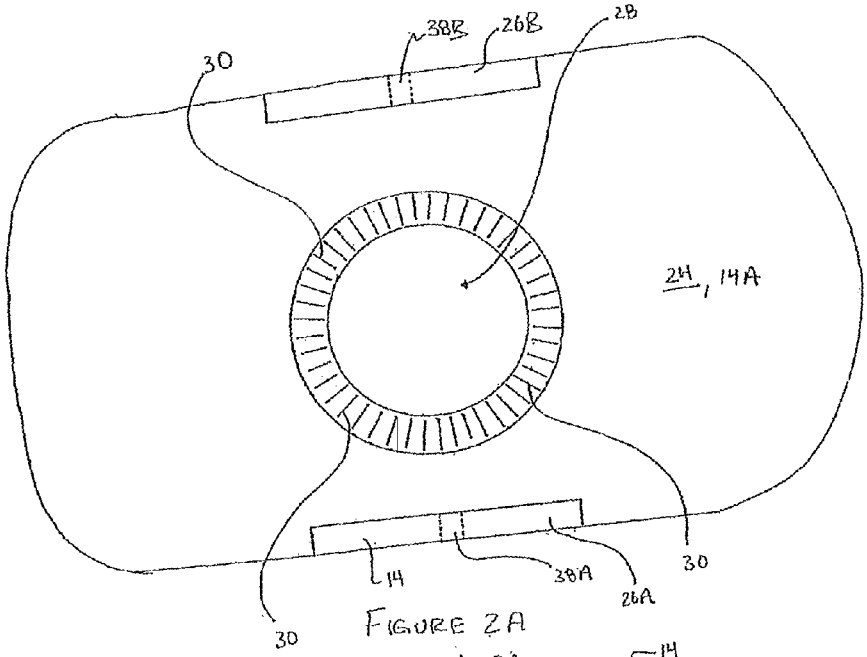
FIGS. 2A, 2B and 2C (collectively, FIG. 2) are plan views of the base of the FIG. 1 binding according to a particular embodiment taken from a top of the base 14, a rear of the base and from a toe-side of the base respectively.
Figure 2B:
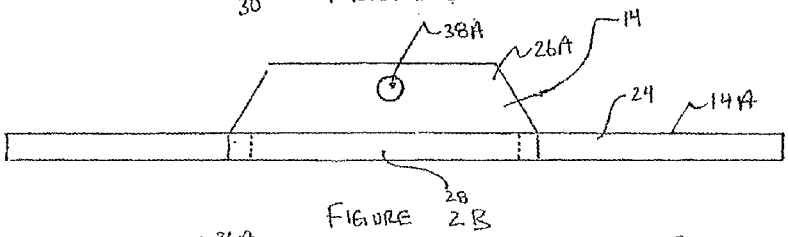
Figure 2C:
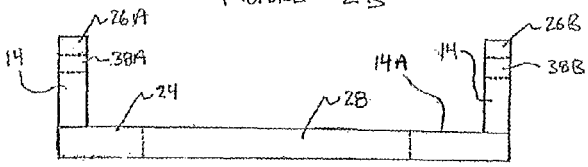

FIGS. 2A-2C respectively show more detailed plan views of base 14 according to a particular embodiment (i.e. from a top of base 14 (FIG. 2A), from the rear of base 14 (FIG. 2B) and from a toe-side of base 14 (FIG. 2C)). Base 14 is rigidly mountable atop rider-support surface 15 of board 10. In the illustrated embodiment, base 14 comprises a base plate 24 which is mountable atop rider-support surface 15 of board 10 and which comprises a generally flattened, upwardly facing foot-receiving surface 14A shaped for receiving a rider's foot thereupon. Base 14 of the illustrated embodiment also comprises a pair of stand-off flanges 26A, 26B (collectively, stand-off flanges 26) that extend upwardly from base plate 24 at opposing sides thereof to locate pivot couplings 20 at locations spaced upwardly apart from foot-receiving surface 14A of base plate 24 and from rider-support surface 15 of board 10. When the rider's foot is retained in binding 12, one standoff flange 26A is located rearwardly of the rider's foot and the other one of the standoff flanges 26B is located forwardly of the user's foot. As shown in FIG. 2A, in the illustrated embodiment, base plate 24 (and in particular foot-receiving surface 14A) may have a perimeter shape at least roughly shaped like the bottom of a rider's foot (or footwear)). This is not necessary, however, and base plate 24 (and foot-receiving surface 14A) may have other suitable perimeter shapes (e.g. generally round, generally oval, generally rectangular or any other suitable shape) capable of providing the functionality described herein.

Figure 3:
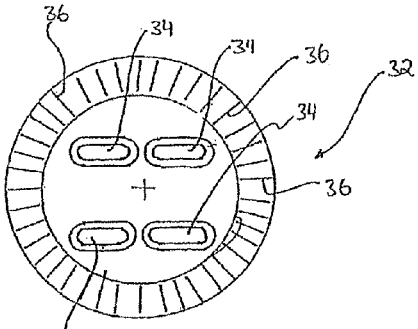
FIG. 3 is a bottom view of a mounting disc which may be used to mount the FIG. 2 base atop the rider-support surface of the FIG. 1 board.

In the illustrated embodiment, base plate 24 comprises a generally circular cut-out 28 with upwardly and radially extending ridges 30 around a perimeter thereof. Cut-out 28 permits base 14 to be rigidly mounted atop rider-support surface 15 of board 10 using a mounting disc 32 (FIG. 3). The use of mounting disc 32 to mount base 14 atop recreational board 10 may be similar to well known prior art techniques of using a mounting disc to mount a binding base plate to a snowboard. In the illustrated embodiment, mounting disc 32 defines a plurality of fastener receiving apertures 34 and is sized to have a radius slightly larger than cut-out 28. Mounting disc 32 may be placed atop cut-out 28 in a desired location on board 10 and suitable fastener components (e.g. screws or the like) may be inserted through apertures 34, through cut-out 28 and into corresponding fastener components (e.g. threaded receptacles) in board 10. Tightening the fastener components causes mounting disc 32 to exert pressure against base plate 24 to thereby rigidly mount base plate 24 atop rider-support surface 15 of board 10.

Mounting disc 32 may comprise a plurality of downwardly and radially extending ridges 36 around a perimeter thereof. Such ridges 36 may interact with corresponding radially and upwardly extending ridges 30 around the perimeter of cut-out 28 to permit pivotal adjustment of base 14 about a vertical axis relative to board 10 when the fastener components are loose or removed. When the fastener components are tightened, interaction of ridges 30, 36 may prevent (or at least mitigate against) movement of base 14 relative to board 10 under the occasionally high torques associated with riding a recreational board. The longitudinal location of base 14 atop rider-support surface 15 of board 10 may be adjusted by decoupling the fastener components that project through apertures 34 from the fastener components in board 10, moving base 14 and mounting disc 32 to a new longitudinal location atop board 10 and re-coupling the fastener components that project through apertures 34 into a new set of fastener components in board 10. Board 10 may be provided with a plurality of longitudinally spaced apart sets of fastener components to facilitate such longitudinal adjustment.

The above-described system using cut-out 28 and mounting disc 32 represents one non-limiting embodiment for rigidly mounting base 14 atop rider-support surface 15 of board 10 and permitting adjustment of the position and/or orientation of base 14 relative to board 10. In other embodiments, other systems and/or modified versions of the above-described system may be used to rigidly mount base 14 atop rider-support surface 15 of board 10 and/or to permit adjustment of the position and/or orientation of base 14 relative to board 10. For example, base 14 (including base plate 24 and/or stand-off flanges 26) may be mounted to board 10 using a channel provided in board 10 and corresponding fasteners similar to those marketed by Burton Snowboards (The Burton Corporation) under the product line EST™.

Returning to FIG. 2, base 14 of the illustrated embodiment comprises stand-off flanges 26. In the FIG. 2 embodiment, flanges 26 extend upwardly from base plate 24 (and foot receiving surface 14A) at opposing sides thereof to locate pivot couplings 20 at locations spaced upwardly from foot-receiving surface 14A of base 14 and rider-support surface 15 or board 10. In some embodiments, base 14 may comprise stand-off flanges 26 without base plate 24 or stand-off flanges 26 may be provided separately from base plate 24 (e.g. as separate components). In such embodiments, rider support surface 15 of board 10 may provide the foot-receiving surface and stand-off flanges 26 may extend upwardly directly from board 10 to locate pivot couplings 20 at locations spaced upwardly apart from the foot-receiving surface (i.e. rider-support surface 15 of board 10). In the illustrated embodiment, stand-off flanges 26A, 26B are respectively penetrated by apertures 38A, 38B (collectively, apertures 38). Apertures 38 may support, and/or provide one or more portions of, pivot couplings 20. In particular embodiments where apertures 38 provide one or more portions of pivot couplings 20, the bore surfaces of apertures 38 may provide portions of the bearing surfaces for suitably configured pivot pins of pivot couplings 20. In such embodiments, the cross-sectional shapes of apertures 38 may be generally circular. In other embodiments, apertures 38 may be replaced by (or used to accommodate or support) one or more components of pivot couplings 20. In such embodiments, pivot couplings 20 may comprise components which themselves are pivotable with respect to one another. In such embodiments, the cross-sectional shapes of apertures 38 may be non-circular.

In the illustrated embodiment of FIGS. 1-5B, base plate 24 extends between stand-off flanges 26A, 26B. This is not necessary. In some embodiments, base 14 comprises stand-off flanges 26 without base plate 24. In such embodiments, which may reduce the weight of binding 12, the rider's foot (or footwear) may be retained directly against rider-support surface 15—i.e. rider-support surface of board 10 provides the foot-receiving surface. In such embodiments, stand-off flanges 26 may extend upwardly directly from board 10 to locate pivot couplings 20 at locations spaced upwardly apart from the foot-receiving surface (i.e. rider-support surface 15 of board 10). In still other embodiments, stand-off flanges 26 and base plate 24 may be provided as separate components.

Figure 7A:
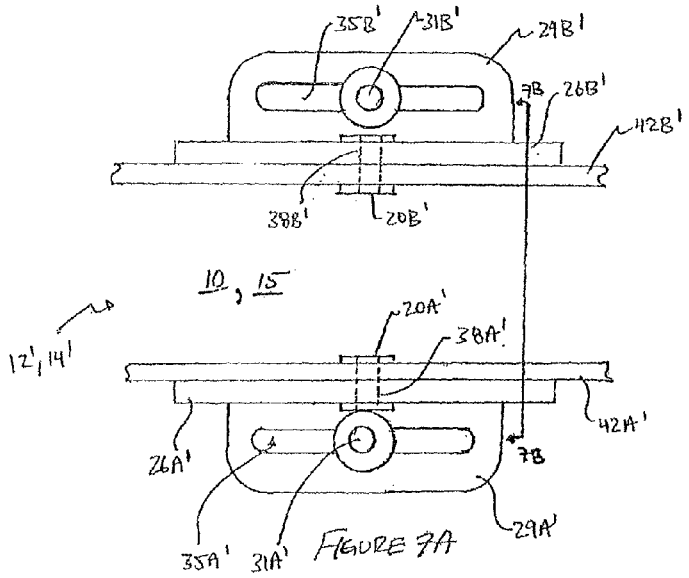
FIGS. 7A and 7B are respectively a partial top view and a partial toe-side cross-sectional (along the line 7B-7B of FIG. 7A) of a binding system according to another embodiment of the invention with the strapping system removed for clarity.
Figure 7B:
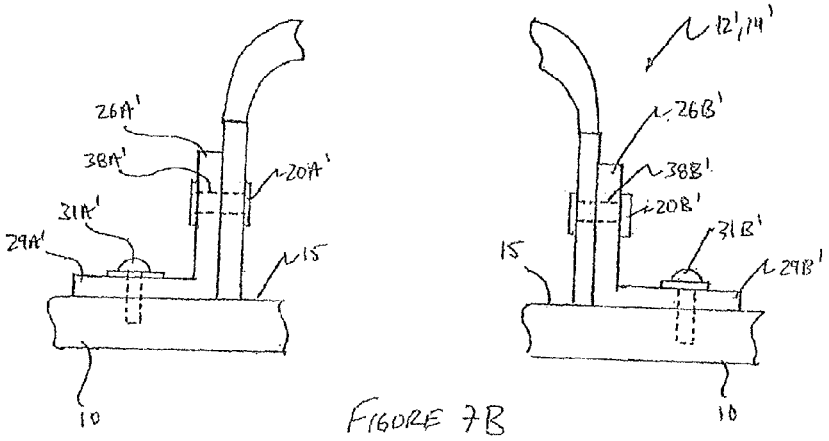

FIGS. 7A and 7B show plan (from above) and toe-side cross-sectional views of a binding 12' according to another embodiment. Binding 12' is similar in many respects to binding 12' of FIGS. 1-5B and features of binding 12' which are similar to corresponding features of binding 12 are described with similar reference numerals annotated with the prime (') symbol. Binding 12' differs from binding 12 primarily in that base 14' of binding 12' comprises a pair of stand-off flanges 26A', 26B' (collectively, stand-off flanges 26'), but does not include a base plate. In the illustrated embodiment of binding 12', the rider's foot (or footwear) is retained directly against rider-support surface 15—i.e. rider-support surface 15 of board 10 provides the foot-receiving surface. When the rider's foot is retained in binding 12', one standoff flange 26A' is located rearwardly of the rider's foot and the other one of the standoff flanges 26B' is located forwardly of the user's foot. In the embodiment of FIGS. 7A and 7B, stand-off flanges 26' are rigidly mounted to board 10 such that stand-off flanges 26' project upwardly from rider-support surface 15 to locate corresponding movement joints 20A', 20B' (collectively, movement joints 20') at locations spaced upwardly apart from rider-support surface 15 of board 10 and spaced upwardly apart from the foot-receiving surface of binding 12'. Movement joints 20' may be similar to movement joints 20' and may provide similar functionality. In the illustrated embodiment of FIGS. 7A and 7B, movement joints 20' comprise pivot couplings 20' and may be referred to as pivot couplings 20'. Pivot couplings 20' of binding 12' may be similar to pivot couplings 20 of binding 12. Stand-off flanges 26' may comprise apertures 38A', 38B' (collectively, apertures 38') which may support, or provide portions of, pivot couplings 20' in a manner similar to apertures 38 of binding 12.

In the illustrated embodiment of FIGS. 7A and 7B, each stand-off flange 26 is provided with a corresponding mounting flange 29A', 29B' (collectively, mounting flanges 29'). Mounting flanges 29' may extend in a plane generally parallel to that of board 10 and may abut against rider-support surface 15. One or more suitable fasteners (e.g. screws, bolts, rivets or the like) 31A', 31B' (collectively, fasteners 31') may project through one or more corresponding apertures 35A', 35B' (collectively, apertures 35') in each of mounting flanges 29' to mount stand-off flanges 26' atop rider-support surface 15. In some embodiments, apertures 35' may be elongated to permit adjustment of the locations and/or orientation of stand-off flanges 26'. In some embodiments, apertures 35' may comprise suitably shaped projections similar to projections 68, 70 of apertures 44 (described below) which may define corresponding retaining locations for the projection of fasteners 31' through apertures 35'. In some embodiments, rear stand-off flange 26A' may be provided with a corresponding mounting flange 29A' that projects rearwardly from rear stand-off flange 26A' and front stand-off flange 26B' may be provided with a corresponding mounting flange 29B' that projects forwardly from front stand-off flange 26B'. Such embodiments, may have the advantage that mounting flanges 29' extend away from (e.g. are not located under) the rider's foot when the rider's foot is located between stand-off flanges 26'. However, this is not necessary. In some embodiments, rear mounting flange 29A' may project in other directions (e.g. forwardly) from rear stand-off flange 26A' and forward mounting flange 29B' may project in other directions (e.g. rearwardly) from forward stand-off flange 26B'.

Binding 12' of FIGS. 7A and 7B also differs from binding 12 in that rails 42A', 42B' (collectively, rails 42') are located inwardly of (i.e. closer to the rider's foot than) stand-off flanges 26'. More particularly, rearward rail 42A' is located forwardly of rearward stand-off flange 26A' and forward rail 42B' is located rearwardly of forward stand-off flange 26B'. This difference is discussed in more detail below.

Returning to binding 12 of FIGS. 1-5B, FIGS. 4A-4C respectively depict rear, top and toe-side views of binding 12 including both base 14 and foot-retainer 18. For clarity, strapping system 47 (which is described in more detail below) is omitted from FIGS. 4B and 4C. In the illustrated embodiment, foot-retainer 18 comprises: a heel retainer 40 which receives the rider's heel; rearward and forward rails 42A, 42B (collectively, rails 42) which extend transversely from heel retainer 40 toward toe edge 24B along the rearward and forward sides of the rider's foot (e.g. adjacent to rearward and forward stand-off flanges 26); and a strapping system 47 which includes one or more straps which retain the rider's foot atop foot-receiving surface 14A, against heel retainer 40 and between a rearward one 42A and a forward one 42B of rails 42.

In the illustrated embodiment, heel retainer 40 comprises a high back portion 41 and a heel cup 45. High back portion 41 and heel cup 45 may be similar in many respects to the high backs and heel cups used in prior art snowboard bindings. High back portion 41 and heel cup 45 may have concave surfaces that open toward toe edge 24B to accommodate the convex surfaces of the heel portion of a rider's foot/footwear.

High back portion 41 may extend upwardly towards the rider's calf, such that the rider may apply force against high back portion 41 and heel edge 24A using their calf. High back portion 41 may be rigidly mounted to heel cup 45 or may be pivotally mounted to heel cup 45 (e.g. at pivot joints 58, only one of which is shown in the illustrated views). Embodiments where high back 41 is pivotally mounted to heel cup 45, may comprise a mechanism (e.g. a pivot stop mechanism) for limiting the pivotal movement of high back portion 41 away from toe edge 24B and rider-support surface 15 and thereby limiting the angular orientation of high back portion 41 relative to rails 42. For example, such a pivot stop mechanism may comprise a protrusion from high back 41 toward heel edge 24A which limits the pivotal movement of high back portion 41 to the configuration shown in FIG. 4A. Such a pivot stop mechanism may be rider-adjustable to permit the rider to control the angular orientation of high back portion 41 relative to rails 42.

In the illustrated embodiment, heel cup 45 comprises a cross-portion 33 which crosses binding 12 and heel cup 45 comprises spaced-apart legs 45A, 45B (collectively, legs 45) which extend downwardly to respective rails 42A, 42B, thereby providing aperture 43 on the heel side of binding 12. In the illustrated embodiment, heel cup 45 is integrally formed with rails 42 or is rigidly joined to rails 42 at spaced apart legs 45A, 45B. This is not necessary. In some embodiments, heel cup 45 may be pivotally mounted to rails 42 (e.g. at legs 45) for limited pivotal movement of heel cup 45 with respect to rails 42.

Strapping system 47 (FIG. 4A) comprises one or more straps which may extend over top of a rider's foot for retaining the rider's foot between rails 42. Strapping system 47 may also help to retain the rider's foot against heel retainer 40. Strapping system 47 may extend between opposing (e.g. forward and rearward) sides of heel retainer 40 and/or between opposing (e.g. forward and rearward) rails 42.

In the illustrated embodiment, strapping system 47 comprises a pair of straps 48A, 48B (collectively, straps 48) which may be similar in many respects to the straps used in prior art snowboard bindings. Straps 48 of the illustrated embodiment are adjustable to an open configuration (not shown) wherein the rider may insert their foot into, or remove their foot from, binding 12 and adjustable to a variety of rider-adjustable closed configurations wherein the rider's foot is retained between rails 42. In the illustrated embodiment, straps 48 may also retain the rider's foot against heel retainer 40 when straps 48 are in their closed configurations. Straps 48 of the illustrated embodiment respectively comprise: first strap portions 50A, 50B (collectively, first strap portions 50); second strap portions 54A, 54B (collectively, second strap portions 54); and lock/adjustment mechanism 52A, 52B (collectively, lock mechanism 52).

Lock/adjustment mechanisms 52 may be mounted on second strap portions 54 and may interact with first strap portions 50 to connect first strap portions 50 to second strap portions 54. In the illustrated embodiment, first strap portions 50 may comprise ridges 56A, 56B (collectively, ridges 56) which extend transversely thereacross and which may be engaged by a corresponding pawl (not shown) in lock/adjustment mechanism 52. Strap portions 50 having such ridges 56 may be referred to as ladder straps 50. In some embodiments, lock/adjustment mechanisms 52 may comprise a ratcheting mechanism (not shown) for tightening ladder straps 50 and a release mechanism (not shown) for releasing ladder strap 50. In other embodiments, other techniques may be used to facilitate the interaction between lock mechanisms 52 and first strap portions 50. Non-limiting examples of such other techniques comprises pivoting buckles or the like.

In the illustrated embodiment, second strap portions 54 comprise pads 55A, 55B (collectively, pads 55) which may distribute some of the pressure that may be applied to the top of the rider's foot. Pads 55 are not necessary.

Strapping system 47 may be mounted to one or more of the other parts of foot-retainer 18 (e.g. to heel retainer 40 and/or to rails 42), such that strapping system 47 moves with foot-retainer 18 when it moves (at movement joints 20) relative to base 14 and/or board 10, as explained in more detail below. In the illustrated embodiment, strap 48A is pivotally mounted to rails 42 at pivot joints 58 and strap 48B is pivotally mounted to rails 42 at pivot joints 60. It should be noted that only one pivot joint 58 and one pivot joint 60 (which mount first strap portions 50 to rail 42A) are shown in the illustrated views, but that there are similar pivot joints (not shown) which mount second strap portions 54 to rail 42B. In other embodiments, one or more parts of strapping system 47 may be mounted to heel retainer 40. Pivot joints 58, 60 allow straps 48 to be pivotally adjustable relative to rails 42 (i.e. for rider comfort or the like), but straps 48 move with foot-retainer 18 when it moves (at movement joints 20) relative to base 14 and/or board 10, as explained in more detail below.

Figure 4A:
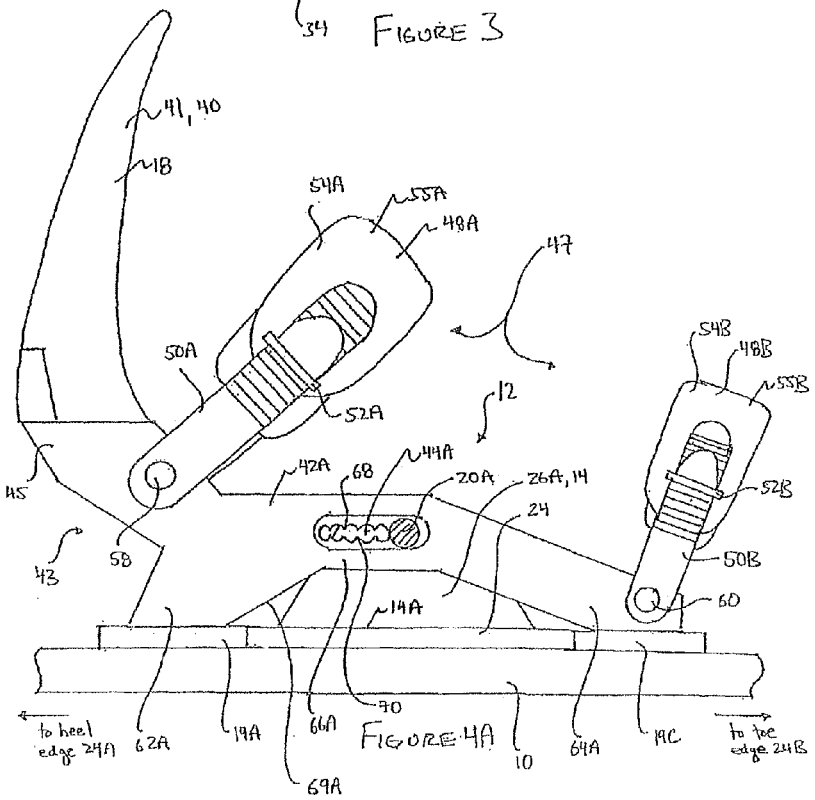
FIG. 4A is a rear plan view of the FIG. 1 binding system showing the strapping system thereof.
Figure 4B:
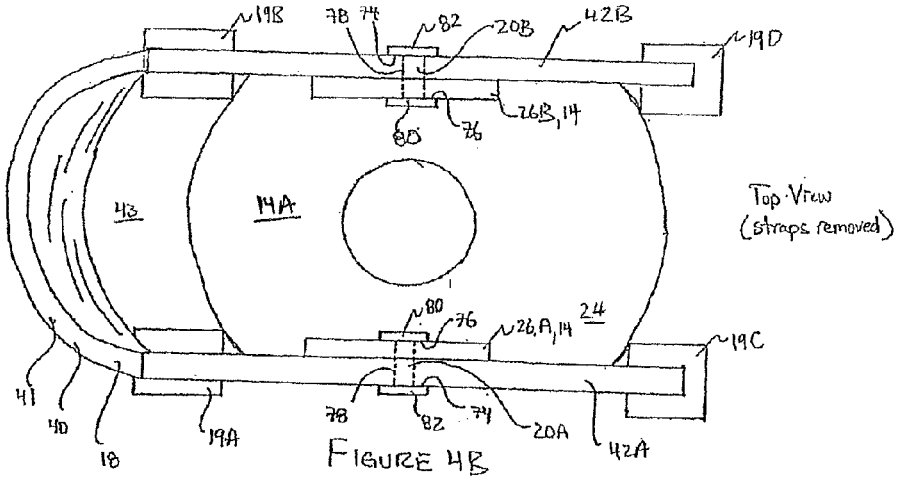
FIGS. 4B and 4C are respectively partial top and partial toe-side views of the FIG. 1 binding system with the strapping system removed for clarity.
Figure 4C:
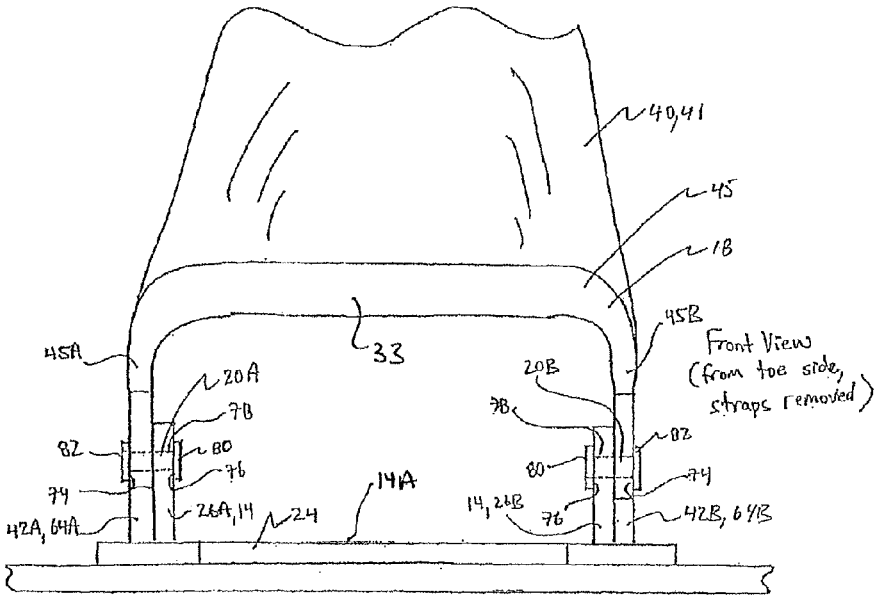

Strapping system 47 shown in FIG. 4A represents one non-limiting embodiment of a strapping system 47 which may extend over top of a rider's foot to retain a rider's foot between rails 42 in binding 12. In other embodiments, strapping system 47 may accommodate a wide variety of modifications, additions or alternatives, such as, by way of non-limiting example:

- strapping system 47 may comprise a different number of straps;
- strapping system 47 may comprise deformable straps (e.g. that stretch or otherwise deform to allow a rider to insert their foot into binding 12;
- strapping system 47 may comprise a different mechanism which allows strapping system 47 to adjust to an open configuration (such that the rider can insert their foot into binding 12) and which allows strapping system 47 to adjust to one or more closed configurations wherein the rider's foot is retained;
- strapping system 47 may comprise straps 48 with different shapes—e.g. toe strap 48B may be provided with a toe cup which extends downwardly on the toe side of the user's toes;
- strapping system 47 may comprise a system similar to those marketed by Flow Snowboarding (USA) and UVEX TOKO Canada Ltd. under their Flow™ binding system; and the like.

Foot-retainer 18 also comprises rails 42. In the illustrated embodiment, when the rider's foot is retained atop foot-receiving surface 14A, a rearward one 42A of rails 42 is located rearwardly of the rider's foot and a forward one 42B of rails 42 is located forwardly of the rider's foot. Rails 42 of the embodiment shown in FIGS. 1-5B are moveably (e.g. pivotally, tiltably, etc.) mounted to stand-off flanges 26 of base 14 at movement joints 20 (e.g. pivot couplings 20) to permit movement (e.g. pivotal movement) of rails 42 relative to board 10 and/or base 14. In the illustrated embodiment of FIGS. 1-5B, rails 42 are pivotally moveable with respect to board 10 and/or base 14 about pivot axis 22. Rails 42 may extend upwardly (away from rider-support surface 15) and along the rearward and forward sides of the rider's foot (e.g. adjacent to rearward and forward stand-off flanges 26) to help retain the rider's foot in binding 12. In the illustrated embodiment, each rail 42 comprises a corresponding downwardly extending heel-side leg 62A, 62B (collectively, heel-side legs 62) and each rail 42 comprises a corresponding downwardly extending toe-side leg 64A, 64B (collectively, toe-side legs 64). Heel-side legs 62 may extend downwardly at or near the heel side of rails 42 to contact optional pads 19A, 19B. Toe-side legs 64 may extend downwardly at or near the toe side of rails 42 to contact optional pads 19C, 19D. Rails 42 may comprise central portions 66A, 66B (collectively, central portions 66) located between heel-side and toe-side legs 62, 64. The shape of rails 42 (including heel-side legs 62, toe-side legs 64 and central portions 66) may provide rails 42 with concave lower edges 69A, 69B (collectively, concave lower edges 69) which open downwardly (i.e. toward foot-receiving surface 14A and rider-support surface 15). With this shape, central portions 66 of rails 42 are spaced upwardly apart from foot-receiving surface 14A and rider-support surface 15. In the illustrated embodiment, pivot joints 20 connect to rails 42 at central portions 66. It will be appreciated that the illustrated views only show one such concave lower edge 69A (FIG. 4A), but that the other concave lower edge 69B may be substantially similar.

While the shape of rails 42 shown in the illustrated embodiment (i.e. downwardly extending legs 62, 64 and concave lower edges 69) may assist with, and/or permit a greater range of pivotal motion, of rails 42 at movement joints 20, this shape is not necessary and the profile of the lower edges of rails 42 may be provided with other shapes (e.g. a relatively flat or the like).

Rails 42 of the embodiment shown in FIGS. 1-5B are pivotally mounted to base 14 (e.g. to stand-off flanges 26) at pivot couplings 20 to permit pivotal movement of rails 42 relative to base 14 and/or board 10 about pivot axis 22. In the illustrated embodiment, pivot couplings 20 are coupled to (or otherwise provided in) central portions 66 of rails 42 at locations which are spaced apart from foot-receiving surface 14A and rider-support surface 15. In some embodiments, pivot couplings 20 are located in a range of 0.5 cm-10 cm from foot-receiving surface 14A or from rider-support surface 15. In particular embodiments, pivot couplings 20 are located in a range of 1.0 cm-5 cm from foot-receiving surface 14A or from rider-support surface 15. In still other embodiments, pivot couplings 20 are located in a range of 1.5 cm-4 cm from foot-receiving surface 14A or from rider-support surface 15. Rails 42 may be shaped to accommodate this desired spacing.

In the illustrated embodiment, rails 42 comprise apertures 44A, 44B (collectively, apertures 44). Apertures 44 may form portions of, or otherwise accommodate or support, pivot couplings 20 between rails 42 and base 14 at locations spaced upwardly apart from rider-support surface 15. In particular embodiments, portions of the bore surfaces of apertures 44 may provide portions of the bearing surfaces for suitably configured pivot pins of pivot couplings 20. In other embodiments, apertures 44 may be replaced by (or used to accommodate or support) one or more components of other types of pivot couplings 20. In such embodiments, the cross-sectional shapes of apertures 44 may be non-circular.

In the illustrated embodiment of FIGS. 1-5B, apertures 44 are generally elongated in a transverse direction which may facilitate transverse adjustment of rails 42 relative to base 14 and pivot couplings 20. In the illustrated embodiment, the upper edges of apertures 44 comprise downwardly extending projections (e.g. teeth) 68 and the lower edges of apertures 44 comprise upwardly extending projections (e.g. teeth) 70. Together, a pair of downwardly extending projections 68 and a pair of upwardly extending projections 70 may provide a retaining location for pivot coupling 20 as it projects through aperture 44. Projections 68, 70 may be shaped such that the retaining locations formed thereby are semi-circularly or otherwise concave shaped. This cross-sectional shape of projections 68, 70 permits rails 42 to bear against, and slide relative to, hinge pins 78 of pivot couplings 20, as described in more detail below.

The transversely elongated shape of apertures 44 is not required. In some embodiments, apertures 38 of stand-off flanges 26 may be provided with a transversely elongated shape, in which case, apertures 44 may be provided with non-elongated shapes. In some embodiments, the transversely elongated shape of apertures 44 (or apertures 38) may be replaced with a plurality of transversely spaced apart apertures which may be used to adjust the transverse position of rails 42 relative to base 14 and pivot couplings 20. In some embodiments, transverse adjustment of rails 42 relative to base 14, board 10 and pivot couplings 20 is not required, in which case apertures 44 may be non-elongated in shape.

In the illustrated embodiment of FIGS. 1-5B, rails 42 are located on the outsides of (i.e. further from the rider's foot than) stand-off flanges 26. More particularly, as shown best in FIG. 4B, rearward rail 42A is located rearwardly of rearward stand-off flange 26A and forward rail 42B is located forwardly of forward stand-off flange 26B. This is not necessary. In general, rails 42 may be located inwardly of (i.e. closer to the riders foot than) stand-off flanges 26. This configuration, is shown for example in binding 12' of FIGS. 7A and 7B, where rails 42' are located inwardly of (i.e. closer to the rider's foot than) stand-off flanges 26'. More particularly, rearward rail 42A' is located forwardly of rearward stand-off flange 26A' and forward rail 42B' is located rearwardly of forward stand-off flange 26B'.

Movement joints 20 of the embodiment shown in FIGS. 1-5B comprise pivot couplings 20. As shown best in FIGS. 4B and 4C, pivot couplings 20 of the embodiment shown in FIGS. 1-5B comprise a pair of pivot-coupling components 80, 82 which extend through apertures 38, 44 and join together to provide hinge pins 78. For example, in one non-limiting embodiment, hinge pin 78 is part of pivot-coupling component 82 which comprises a threaded bore that is axially aligned with hinge pin 78 on an interior thereof and pivot-coupling component 80 comprises a threaded shaft which threadably extends into the threaded bore to complete pivot coupling 20.

Hinge pins 78 may have a substantially circular cross-section. In this embodiment, one or both rails 42 and base 14 may pivot relative to hinge pins 78. For example, apertures 38 may be provided with a substantially circular cross-section, such that the edge(s) of apertures 38 bear on, and slide relative to, hinge pins 78 to allow relative pivotal motion between hinge pins 78 and stand-off flanges 26. Similarly, hinge pins 78 may bear on, and slide relative to, the edges of apertures 44 to allow relative pivotal motion between hinge pins 78 and rails 42. In some embodiments, the semi-circular cross-sectional shape provided by projections 68, 70 may allow the edges of projections 68, 70 to bear on, and slide relative to, hinge pins 78.

Pivot couplings 20 of the illustrated embodiment represent one particular non-limiting type of pivot coupling 20. In other embodiments, pivot couplings 20 may comprise any suitable pivot joints which facilitate pivotal movement of rails 42 relative to board 10 and/or base 14 (e.g. stand-off flanges 26) about pivot axis 22.

In some embodiments, pivot couplings 20 may comprise internal pivot joints (e.g. internal bearing surfaces, internal ball-bearing races or the like) which permit pivot-coupling components 80, 82 (or other pivot-coupling components) to pivot relative to another to facilitate the pivotal movement of rails 42 relative to base 14 and/or board 10. In such embodiments, the internal pivot mechanisms of pivot couplings 20 permit rails 42 to be fixed (in non-pivoting relationships) to pivot-coupling components 82 and base 14 to be fixed (in non-pivoting relationships) to pivot coupling components 80. In such embodiments, the cross-sectional shapes of apertures 38 (of base 14) and 44 (of rails 42) may be non-circular in shape to maintain these fixed (non-pivoting relationships). In some embodiments, such non-circular cross-sections may be provided by suitably shaped projections similar to projections 68, 70 (FIG. 4A). Similarly, in such embodiments, the portion 78 of pivot couplings 20 that extends between flanges 74, 76 of pivot-coupling components 82, 80 may have a non-circular cross-section.

Additionally or alternatively, in such embodiments, central portions 66 of rails 42 may be provided with ridges around a perimeter of transversely elongated apertures 44 which may engage corresponding ridges on flanges 74 of pivot-coupling components 82. Stand-off flanges 26 of bases 14 may be provided with similar ridges around apertures 38 for engaging similar ridges on the flanges of pivot-coupling components 80. Such ridges may interact with one another in a manner similar to ridges 36 of mounting disc 32 and ridges 30 of base plate 24. In addition to helping to maintain a non-pivoting relationship between rails 42 and pivot couplings 20 and between base 14 and pivot couplings 20, the interaction of these ridges may help to retain pivot couplings 20 in a particular transverse location within transversely elongated apertures 44. In some embodiments, these ridges may assist projections 68, 70 to retain pivot couplings 20. In other embodiments, these ridges may be used in the place of projections 68, 70 to retain pivot couplings 20 in desired transverse locations.

Figures 5A, 5B:
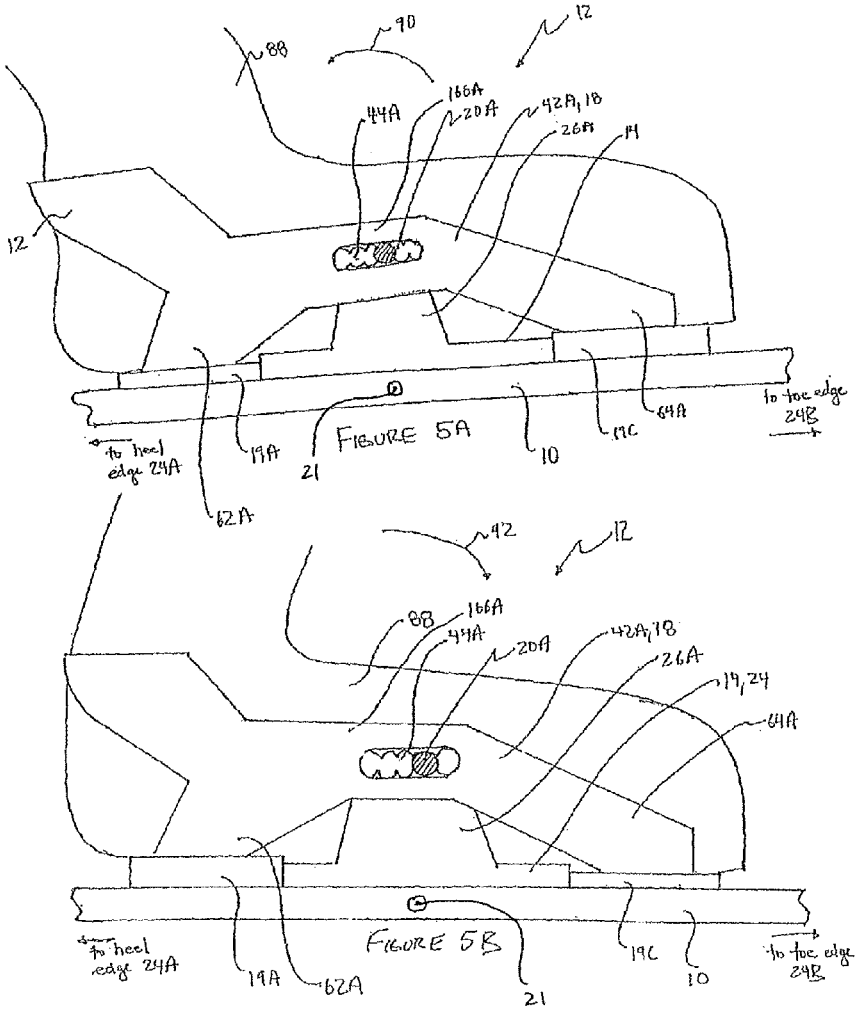
FIGS. 5A and 5B respectively depict the operation of the FIG. 1 binding system to move toward, and thereby apply force to, the heel-side edge and the toe-side edge of the FIG. 1 board.

The operation of binding 12 is illustrated in FIGS. 5A and 5B which show a portion of binding 12 with a rider's foot 88 retained therein. The rider's foot 88 (or footwear) is retained with atop foot-receiving surface 4A (see FIGS. 4A-4C) with the rider's toes on one side of longitudinal axis 21 of board 10 and the rider's heel is retained on the opposing side of longitudinal axis 21. As discussed above, the rider's foot 88 is retained in foot-retainer 18, such that when the rider applies force to foot-retainer 18 (using their foot 88), foot-retainer 18 moves (e.g. pivots) with respect to base 14 and/or board 10 at movement joints (e.g. pivot couplings) 20. The motion (e.g. pivotal motion) of foot-retainer 18 and the corresponding motion (e.g. pivotal motion) of the rider's foot with respect to base 14 and/or board 10 may allow the rider to move their foot relative to base 14 and/or board 10 in a manner which directs relatively more of the forces associated with rider's weight and/or other forces exerted by the rider onto one of the heel edge 24A and/or the toe edge 24B (e.g. by moving (e.g. pivoting) their foot relatively close to the heel edge 24A and/or toe edge 24B). Such relative movement of the rider's foot may in turn allow the rider greater control over the transfer of weight to heel edge 24A and/or to toe edge 24B of board 10.

In FIG. 5A, a rider is applying force to their foot 88 (and/or other parts of their body) which would tend to increase the force on heel edge 24A of board 10. In such a configuration, foot 88 (and/or other parts of the rider's body) apply force to foot-retainer 18 (e.g. against heel retainer 40 and/or strapping system 47) and these forces tend to move (e.g. pivot) foot-retainer 18 toward heel edge 24A (e.g. in the illustrated embodiment, to pivot foot-retainer 18 with respect to base 14 and/or board 10 in the angular direction indicated by arrow 90). When foot-retainer 18 pivots in this manner, it tends to compress pads 19A and 19B (i.e. the pads 19 closest to heel edge 24A) and, in some embodiments, may permit pads 19C and 19D (i.e. pads 19 closest to toe edge 24B) to expand. The motion of foot-retainer 18 (relative to base 14 and/or board 10) in direction 90 allows the rider greater control over the transfer of weight to heel edge 24A.

In FIG. 5B, the rider is applying force to their foot 88 (and/or other parts of their body) which would tend to increase the force on toe edge 24B of board 10. In such a configuration, foot 88 (and/or other parts of the rider's body) apply force to foot-retainer 18 (e.g. against strapping system 47) and these forces tend to move (e.g. pivot) foot-retainer 18 toward toe-edge 24B (e.g. in the case of the illustrated embodiment, to pivot foot-retainer 18 with respect to base 14 and/or board 10 in the angular direction indicated by arrow 92). When foot-retainer 18 pivots in this manner, it tends to compress pads 19C and 19D (i.e. pads 19 closest to toe edge 24B) and, in some embodiments, may permit pads 19A and 19B (i.e. the pads 19 closest to heel edge 24A) to expand. The motion of foot-retainer 18 (relative to base 14 and/or board 10) in direction 92 allows the rider greater control over the transfer of weight to toe edge 24B.

Pads 19 may be adhesively bonded or otherwise fastened (by suitable fasteners or suitable fastening mechanisms) atop rider-support surface 15 of board 10. Pads 19 may additionally or alternatively be adhesively bonded or otherwise fastened (by suitable fasteners or suitable fastening mechanisms) to the bottoms of legs 62, 64 of rails 42. Depending on the materials from which pads 19 are fabricated, pads 19 may become fatigued with extensive use or over time. Such fatigue may reduce the forces associated with deforming (i.e. compressing) pads 19 and may reduce the restorative forces that tend to cause pads 19 to restore themselves to their original size and shape. In such embodiments, it may be desirable to replace pads 19 from time to time. In such embodiments, it may be desirable to mount pads 19 atop rider-support surface of board 10 or to legs 62, 64 using a removable adhesive and/or a removable fastening system. In some embodiments, binding 12 may be provided with a variety of rider-selectable pads 19 having various thickness or various deformation characteristics (e.g. densities), such that a rider may select between pads 19 having suitable characteristics for their particular riding style. For example, in some embodiments, binding 12 may be provided with a plurality of interchangeable pads 19 having a plurality of discrete thicknesses in a range between 2 mm-15 mm. In some embodiments, this range may be between 3 mm-10 mm.

In some embodiments, the restorative forces associated with the deformation of pads 19 may be such that contact is either maintained between pads 19 and legs 62, 64 of rails 42 and/or between pads 19 and board 10 or there is minimal space between pads 19 and legs 62, 64 of rails 42 and/or between pads 19 and board 10 for most of the torques associated with conventional riding. Maintaining contact between legs 62, 64 and pads 19 is not necessary. In some embodiments, it may be possible to pivot foot-retainer 18 sufficiently far in direction 90 (FIG. 5A) that toe-side legs 64 separate from toe-side pads 19C, 19D or toe-side pads 19C, 19D separate from rider-support surface 15 of board 10 and/or sufficiently far in direction 92 (FIG. 5B) that heel-side legs 62 separate from heel-side pads 19A, 19B or heel side pads 19A, 19B separate from rider-support surface 15 of board 10.

Pads 19 may be fabricated from any suitable resilient material which may be deformed (e.g. compressed) under the forces associated with the operational movement of binding 12 as described above. Pads 19 may be fabricated from a material which tends to elastically restore itself (e.g. to expand) to its original shape and size when such forces are removed or reduced. Suitable materials for pads 19 includes various types of elastomeric materials, foam, rubber, suitable plastics, suitable polymeric materials and/or the like. It will be appreciated that resiliently (e.g. elastically) deformable pads 19 may act as springs in allowing compression and providing restorative forces which tend to restore pads 19 to their uncompressed states.

Figure 5C:
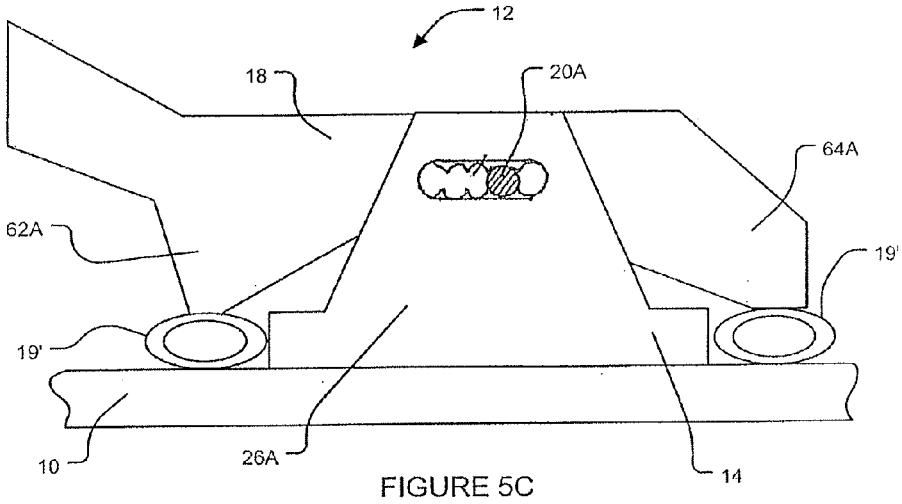
FIGS. 5C and 5D respectively depict rear plan views of other embodiments of binding systems (with the strapping system removed for clarity) which may be used to move toward, and thereby apply force to, the heel-side edge and the toe-side edge of the FIG. 1 board.
Figure 5D:
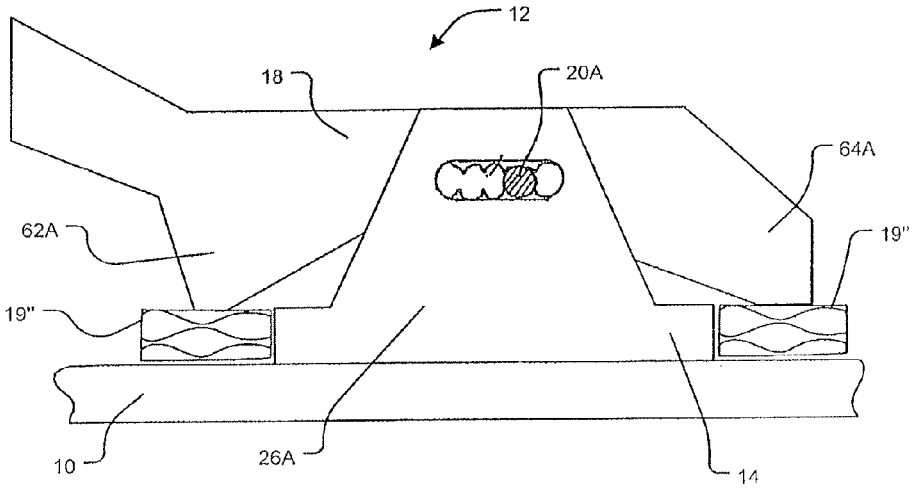

In some embodiments pads 19 may comprise springs such as compression springs 19' as shown in FIG. 5C or wave springs 19" as shown in FIG. 5D. The use of springs may allow for increased restorative forces when the forces associated with the operation of binding 12 are reduced or removed. For example, wave springs are designed to provide relatively large restorative forces and deformable range for a given spring height. Relatively high restorative forces provided by springs 19', 19" may make it easier for a rider to move out of a heel-side turn into a toe-side and vice versa by way of the restorative force. This may reduce the force needed to be applied by the rider to the board when exiting a turn, thus reducing the stress on the rider. The stiffness, diameter, deflection, etc. of the springs 19', 19" may be configured as desired to provide more or less deflection and more or less restorative force. It will be appreciated that other types of springs may be used in appropriate circumstances such as coil springs, air springs, urethane springs or the like. In other respects, springs 19', 19" may be similar to and function similar to pads 19 described herein.

The illustrated embodiment of FIGS. 1-5B, movement joints 20 of binding 12 comprise pivot couplings 20 which pivot about pivot axis 22 that is generally concentric with pivot couplings 20. This is not necessary. In some embodiments, movement joints 20 may provide different techniques for moving a foot-retainer and a rider's foot relative to a base and/or a recreational board 10.

Figure 6A:
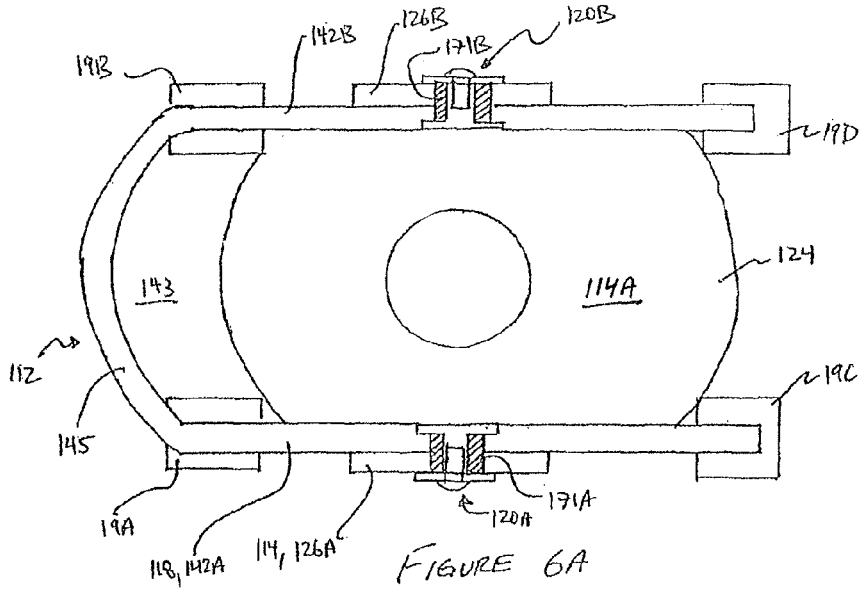
FIGS. 6A and 6B are respectively partial top cross-sectional and partial rear views of a binding system according to another embodiment of the invention with the strapping system removed for clarity.
Figure 6B:
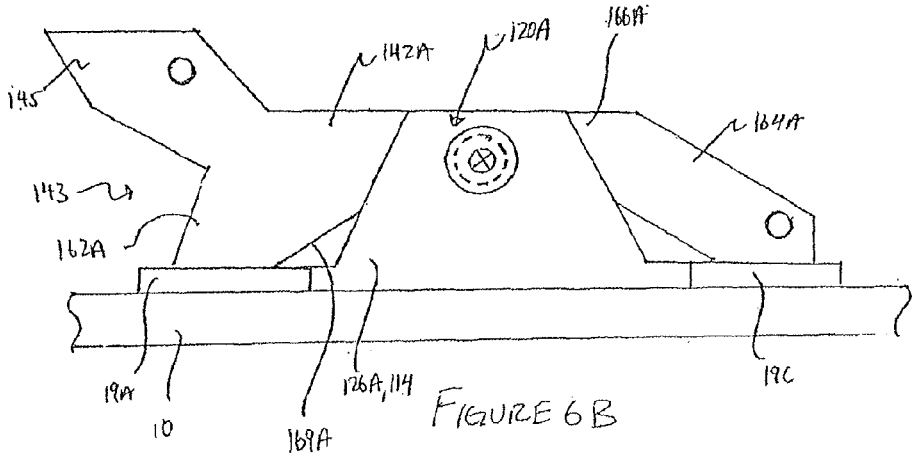

FIGS. 6A and 6B respectively depict partial top cross-sectional and partial rear views of a binding system 112 according to another embodiment. For clarity, the strapping system of binding system 112 is not shown in FIGS. 6A and 6B. In many respects, binding system 112 is similar to binding system 12 described above. More particularly, binding system 112 comprises a base 114 which is rigidly mounted to board 10 such that stand-off flanges 126A, 126B (collectively, stand-off flanges 126) extend upwardly from rider-support surface 15 of board 10 to locate movement joints 120A, 120B (collectively, movement joints 120) at locations spaced upwardly apart from rider-support surface 15 and from foot-receiving surface 114A of base plate 124. In the illustrated embodiment of FIGS. 6A and 6B, base 114 also comprises a base plate 124, but, in a manner similar to binding 12' of FIGS. 7A and 7B, base plate 124 is not necessary—i.e. rider support surface 15 of board 10 may provide the foot-receiving surface. Binding 112 also comprises a foot-retainer 118 which is coupled to base 114 via movement joints 120 so as to be moveable relative to board 10 and/or base 114. Foot-retainer 118 of binding 112 is similar in many respects to foot-retainer 18 of binding 12 and comprises: a heel cup 145 which defines a heel-side aperture 143, a pair of rails 142A, 142B (collectively rails 142) which extend from heel cup 145 toward the toe-side of board 10, a high back (not shown in the illustrated views) and a strapping system (not shown in the illustrated views). In the illustrated embodiment, rails 142 comprise heel-side legs 162A, 162B (collectively, heel-side legs 162) and toe-side legs 164A, 164B (collectively, toe-side legs 164) and central portions 166A, 166B (collectively, central portions 166) which together define concave lower edges 169A, 169B (collectively, concave lower edges 169). These features of rails 142 of binding 112 may be similar to corresponding features of rails 42 of binding 12. Binding system 112 may also comprise pads 19 between heel-side legs 62, toe-side legs 64 and rider-support surface 15 of board 10.

Binding 112 differs primarily from bindings 12 described above in that movement joints 120 of binding 112 are not limited to pivot couplings, but permit more generalized movement of foot-retainer 118 and the rider's foot relative to base 114 and/or board 10. Movement joints 120 comprise deformable (e.g. compressible) bushings 171A, 171B (collectively, bushings 171) which may be deformed to facilitate movement between foot-retainer 118 and base 114. Bushings 171 may be elastically deformable such that they tend to restore their original shape after being compressed by external forces.

Figure 6C:
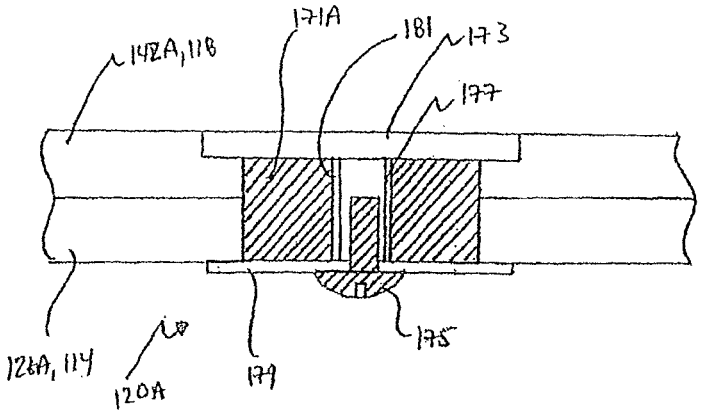
FIGS. 6C and 6D are respectively magnified cross-sectional and magnified exploded cross-sectional views of a movement joint between a rail and a stand-off flange of the FIG. 6A, 6B binding system.
Figure 6D:
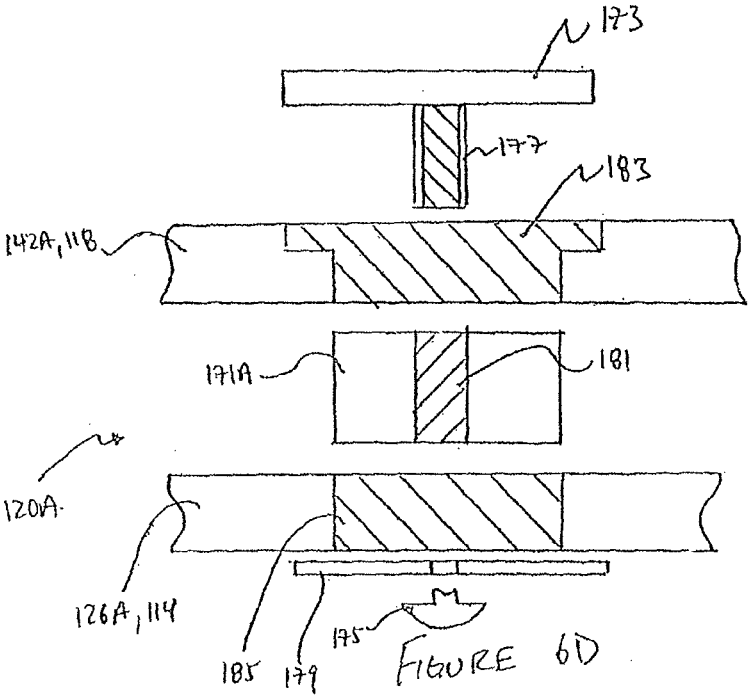

FIGS. 6C and 6D are respectively magnified cross-sectional and magnified exploded cross-sectional views of movement joint 120A between rail 142A of foot-retainer 118 and stand-off flange 126A of base 114 of binding 112. As can be seen from FIGS. 6C and 6D, movement joint 120A comprises a bushing 171A which has a portion located in an aperture 183 of rail 142 and a portion located in an aperture 185 of stand-off flange 126A. Bushing 171A is penetrated by a bore 181. Movement joint 120A also comprises a pair of fastener components 173, 175 which are coupleable to one another from opposing sides of rail 142A and stand-off flange 126A to provide a central shaft 177 which extends through bore 181 of bushing 171A. In one particular embodiment, fastener component 173 comprises a female threaded bore 177 and fastener component 175 comprises a male threaded shaft that is threadably extendable into bore 177. In some embodiments, one or more washers 179 may be provided between fastener components 173, 175. In other embodiments, different fastener components can be used in addition to or as an alternative to fastener components 173, 175.

In operation, when a user exerts force on foot-retainer 118, portions of bushings 171 of movement joints 120 may be compressed to facilitate the movement of foot-retainer 118 relative to base 114 and/or board 10. In addition to displacement via compression of bushings 171, movement joints 120 may also permit pivotal movement—for example, foot-retainer 118 may pivot about the outer surface of bushings 171, foot-retainer 118 and bushings 171 may pivot about shaft 177; and/or fastener components 173, 175 may be provided with internal pivot mechanisms. Such movement of foot-retainer 118 relative to base 114 and/or board 10 may also comprise compression of one or more of pads 119. The motion of foot-retainer 118 and the corresponding motion of the rider's foot with respect to base 114 and/or board 10 may allow the rider to move their foot relative to base 114 and/or board 10 in a manner which directs relatively more of the forces associated with rider's weight and/or other forces exerted by the rider onto one of the heel edge 24A and/or the toe edge 24B (e.g. by moving their foot relatively close to the heel edge 24A and/or toe edge 24B). Such relative movement of the rider's foot may in turn allow the rider greater control over the transfer of weight to heel edge 24A and/or to toe edge 24B of board 10.

Binding 112 also differs from binding 12 of FIGS. 1-5B in that rails 142 are located on the insides of (i.e. closer to the rider's foot than) stand-off flanges 126, whereas rails 42 of binding 12 are located on the outsides of (i.e. further from the rider's foot than) stand-off flanges 26. However, this relative orientation may be changed for any of bindings 12, 12', 112. More particularly, for binding 112, rails 142 may be located on the outsides of stand-off flanges 126. Similarly, rails 42, 42' of binding systems 12, 12' may be located inside or outside stand-off flanges 26, 26'.

Figure 6E:
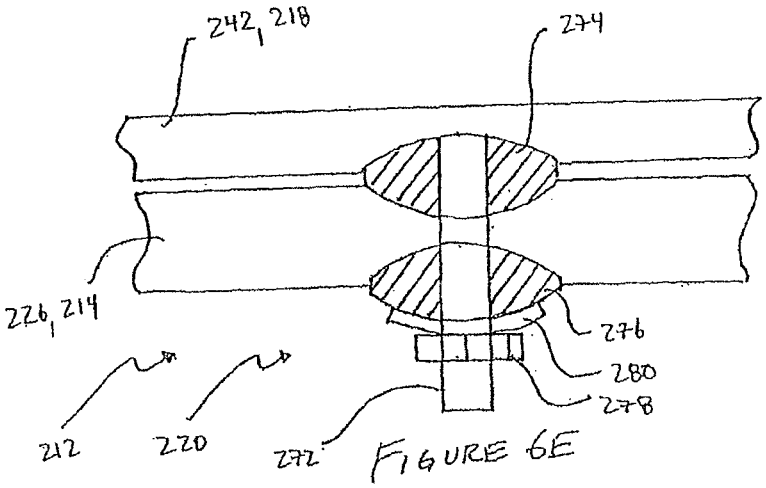
FIGS. 6E and 6F are respectively magnified cross-sectional and magnified exploded cross-sectional views of another example movement joint suitable for use between a rail and a stand-off flange of a binding system according to another example embodiment.
Figure 6F:
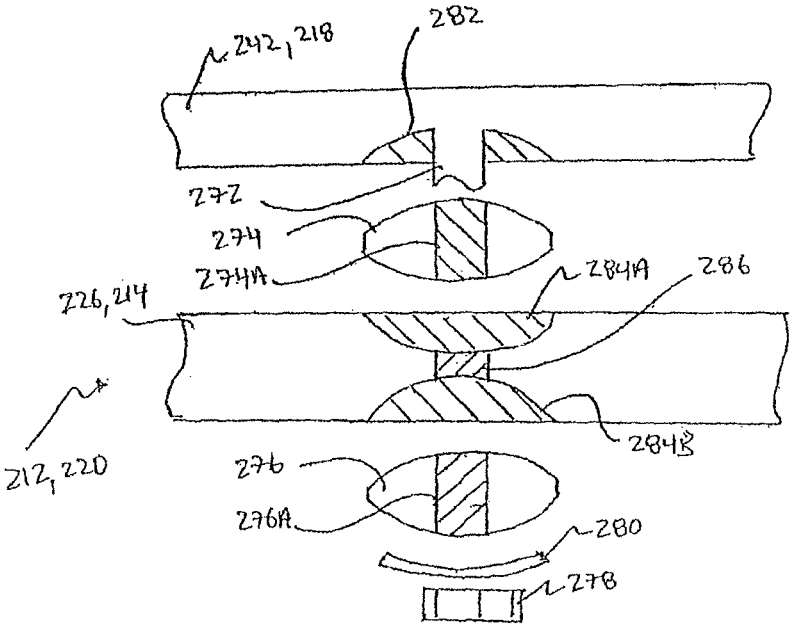

In other embodiments, the movement joints between foot-retainers and bases may be provided by a variety of other configurations which involve the deformation (e.g. compression) of elastomeric bushings. FIGS. 6E and 6F are respectively magnified cross-sectional and magnified exploded cross-sectional views of another example movement joint 220 suitable for use between a rail 242 and a stand-off flange 226 of a binding system 212 according to another example embodiment. Movement joint 220 may be used as an alternative movement joint for any of the binding systems described herein. Movement joint 220 comprises a king pin shaft 272 which may be threaded. In the illustrated embodiment, king pin shaft 272 is integrally formed with and extends outwardly from rail 242. In other embodiments, king pin shaft 272 may be integrally formed with stand-off 226 or may be coupleable to either rail 242 or stand-off 226. Movement joint 220 also comprises a pair of bushings 274, 276 having corresponding bores 274A, 276A such that king pin shaft 272 extends through bores 274A, 276A. King pin shaft 272 extends from rail 242 through bore 274A of first bushing 274 which is located between rail 242 and stand-off flange 226. Rail 242 and stand-off flange 226 may comprise concavities 282, 284A which accommodate portions of first bushing 274. King pin shaft 272 then extends through a bore 286 of stand-off flange 226. King pin shaft 272 then extends through bore 276A of second bushing 276 which is located on an outside of stand-off flange 226. Stand-off flange 226 may comprise a concavity 284B for accommodating a portion of second bushing 276. King pin shaft 272 of the illustrated embodiment is then capped by suitable fastener components which, in the illustrated embodiment, comprise a washer 280 and a nut 278.

In operation, when a user exerts force on foot-retainer 218, portions of bushings 274, 276 of movement joints 220 may be compressed to facilitate the movement of foot-retainer 218 relative to base 214 and/or board 10. Such movement of foot-retainer 218 relative to base 214 and/or board 10 may also comprise compression of one or more of pads similar to pads 19 described above. The relative amount of force required to compress bushings 274, 276 may be controlled be the tightness of fastener component 278 on king pin shaft 272. For example, when fastener component 278 is relatively tight on king pin shaft 272, it may pre-compress bushings 274, 276, making it relatively hard for a rider to further compress bushings 274, 276 to move foot-retainer 218 relative to base 214 and/or board 10. In contrast, when fastener component 278 is relatively loose on king pin shaft 272, it is relatively easy to compress bushings 274, 276 and to thereby move foot-retainer 218 relative to base 214 and/or board 10.

In the illustrated embodiment of movement joint 220, king pin shaft 272 is integrally formed with or rigidly connected to rail 242 and extends through stand-off flange 226. In other embodiments, the king pin shaft could be integrally formed with or rigidly connected to stand-off flange 226 and could extend through rail 242.

Figure 6G:
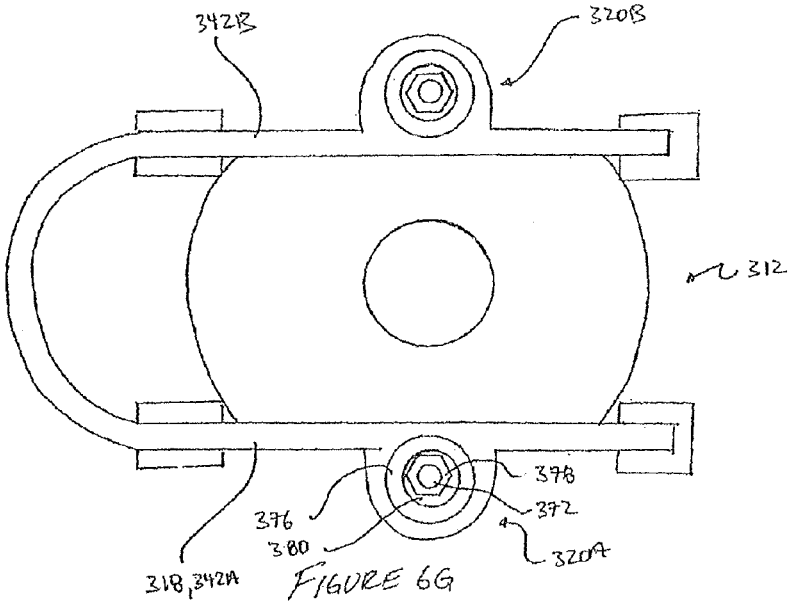
FIGS. 6G and 6H are respectively partial top and partial rear views of a binding system according to another embodiment of the invention with the strapping system removed for clarity.
Figure 6H:
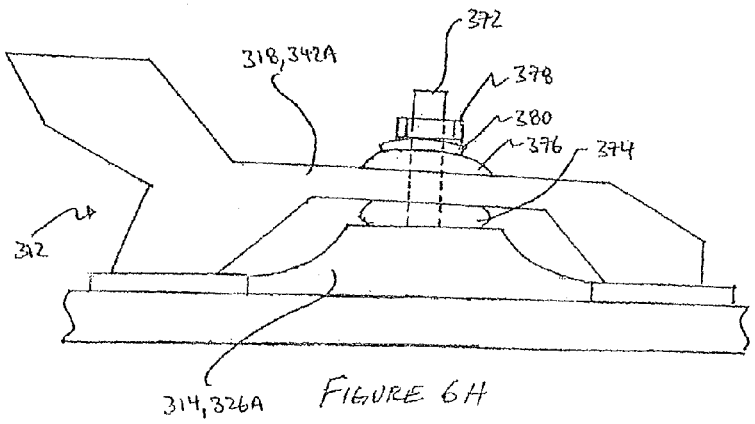

FIGS. 6G and 6H are respectively partial top and partial rear views of a binding system 312 according to another embodiment of the invention comprising another type of movement joint 320A, 320B (collectively, movement joints 320) which facilitate relative movement between foot-retainer 318 and base 314 and board 10. For clarity, the strapping system of binding 312 is not shown in FIGS. 6G, 6H. Movement joints 320 of the illustrated embodiment of FIGS. 6G and 6H facilitate relative movement between rails 342A, 342B (collectively, rails 342) and stand-off flanges 326A, 326B (collectively, stand-off flanges 326). Movement joints 320 are similar to movement joints 220 (FIGS. 6E, 6F), except that king pin shafts 372 of movement joints 320 are oriented generally vertically. More particularly, movement joint 320 comprise king pin shafts 372 which extend upwardly from stand-off flanges 326 through first deformable bushings 374, through rails 342 and through second deformable bushings 376. Fastener components 378 and optional washers 380 threadably tighten onto king pin shafts 372. Bushings 374, 376 may be elastically deformable.

Operation of movement joints 320 may be similar to operation of movement joints 220. When a user exerts force on foot-retainer 318, portions of bushings 374, 376 may be compressed to facilitate the movement of foot-retainer 318 relative to base 314 and/or board 10. Such movement of foot-retainer 318 relative to base 314 and/or board 10 may also comprise compression of one or more of pads similar to pads 19 described above Like movement joints 220 described above, the relative amount of force required to compress bushings 374, 376 may be controlled be the tightness of fastener component 378 on king pin shaft 372.

In the illustrated embodiment of movement joint 320, king pin shaft 372 is integrally formed with or rigidly connected to stand-off flange 326 and extends upwardly through rail 342. In other embodiments, the king pin shaft could be integrally formed with or rigidly connected to rail 342 and could extend through stand-off flange 326.

Figure 8:
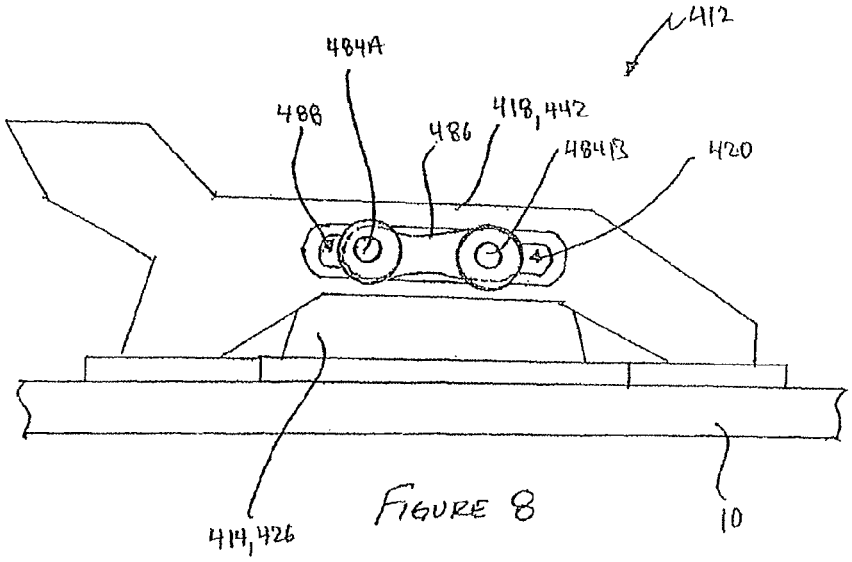
FIG. 8 is a partial rear plan view of a binding system according to another embodiment of the invention with the strapping system removed for clarity.

FIG. 8 is a partial rear of a binding system 412 according to another embodiment of the invention with the strapping system removed for clarity. Binding system 412 comprises yet another type of movement joint 420 which facilitates the relative movement between foot-retainer 418 (e.g. rails 442) and base 414 (e.g. stand-off flanges 426). Movement joint 420 comprises a pair of fasteners 484A, 484B which extend through apertures 488 in rails 442, deformable bushing 486 and comparable apertures in stand-off flanges 426. Deformable bushing 486 may be elastically deformable and may tend to restore itself when compressed. The plurality of fasteners 484 may add strength to movement joint 420. In operation, movement joint 420 may be similar to movement joint 120 of FIGS. 6A-6D. Forces applied by a rider to foot-retainer 418 cause compression of bushing 486 and corresponding movement of foot-retainer 418 (e.g. rails 442) relative to base 414 (e.g. stand-off flanges 426) and/or board 10.

Figure 9A:
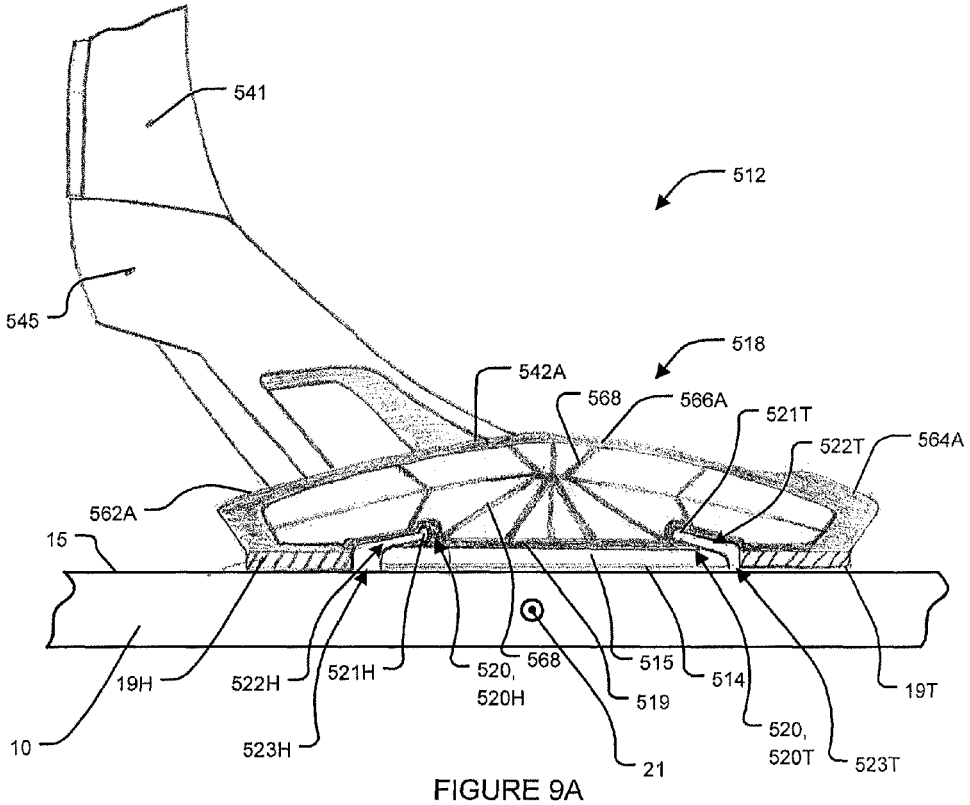
FIG. 9A is a rear plan view of a binding system according to another embodiment of the invention with the strapping system removed for clarity.
Figure 9B:
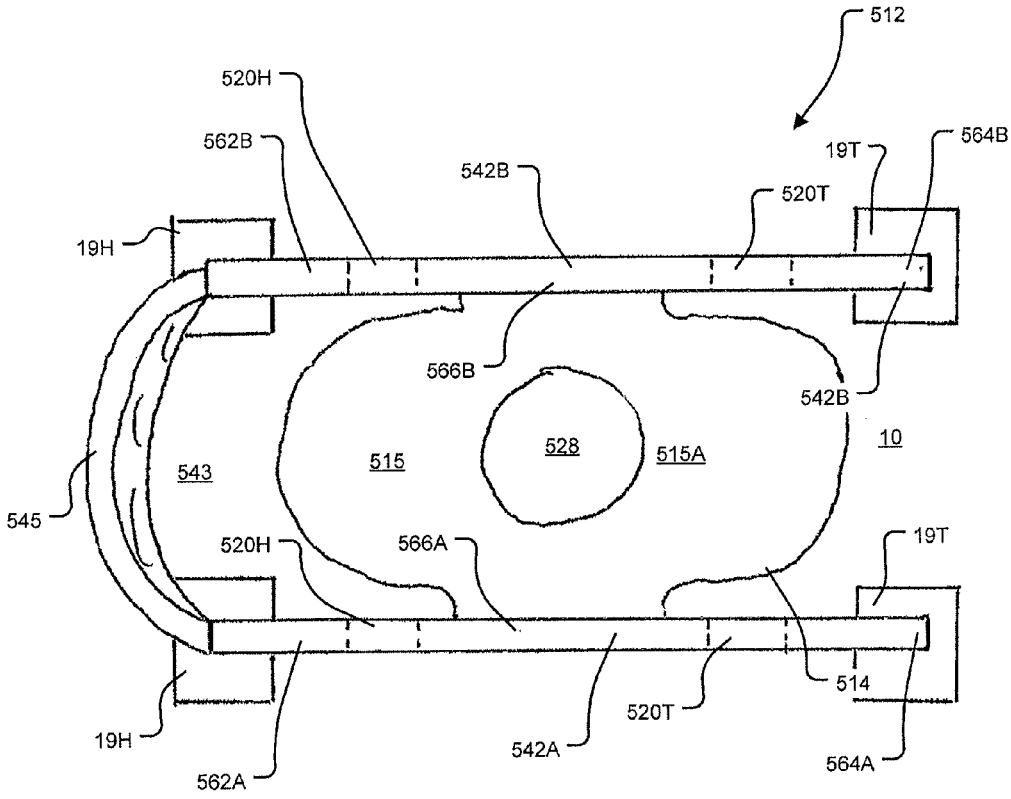
FIG. 9B is a top plan view of the FIG. 9A binding system with the strapping system removed for clarity.

FIG. 9A is a rear plan view and FIG. 9B is a top plan view of a binding system 512 according to another embodiment of the invention with the strapping system removed for clarity. Binding system 512 is suitable for use with recreational board 10 (FIG. 1). In some respects, binding system 512 is similar to binding system 12 described above. More particularly, binding system 512 comprises a foot-retainer 518 for retaining a rider's foot in a manner similar to binding system 12 described above. In the FIG. 9A embodiment, foot-retainer 518 comprises a heel cup 545 which defines a heel-side aperture 543, a pair of rails 542A, 542B (collectively, rails 542) which extend across longitudinal axis 21 of board 10 (e.g. from heel cup 545 toward the toe-edge 24B of board 10), a high back 541 and a strapping system (not shown in the illustrated view).

Rails 542 of binding 512 are spaced apart from one another along longitudinal axis 21 of board 10, so that they can receive a rider's foot (or footwear) therebetween with the rider's toes on one side of longitudinal axis 21 and the rider's heel on the other side of longitudinal axis 21. In the illustrated embodiment, rails 542 comprise heel-side legs 562A, 562B (together, heel-side legs 562), toe-side legs 564A, 564B (together, toe-side legs 564) and central rail portions 566A, 566B (together, central rail portions 566) located between heel-side legs 562 and toe-side legs 564. Binding system 512 of the illustrated embodiment also comprises optional pads 19H between heel-side legs 562 and rider-support surface 15 of board 10 and optional pads 19T between toe-side legs 564 and rider-support surface 15 of board 10.

Binding system 512 differs from binding system 12 primarily in that, rather than providing movement joints, rails 542 of binding system 542 are designed to deform elastically to permit movement of the rider's foot relative to board 10. More particularly, each of rails 542 comprises one or more deformation-enhancing features 520 which enhance the ability of rails 542 to deform elastically relative to the board. In some embodiments, each deformation-enhancing feature 520 may enhance the ability of a corresponding rail 542 to deform in a vicinity of the deformation-enhancing feature 520 which may be referred to herein as a deformation-enhancement region. In the illustrated embodiment, each rail 542 comprises a pair of deformation-enhancing features 520 which include a heel-side deformation-enhancing feature 520H (generally located between heel-side leg 562 and central rail portion 566) and a toe-side deformation-enhancing feature 520T (generally located between toe-side leg 564 and central rail portion 566). In other embodiments, each rail 542 may comprise a different number of deformation-enhancing features 520 which may be located at different positions on rail 542.

In the illustrated embodiment, deformation-enhancing features 520 comprise cut-away slots 522H (heel-side), 522T (toe-side) which have open ends 523H (heel-side), 523T (toe-side) at one or more edges of a corresponding rail 542 and which extend inwardly into the corresponding rail 542 to provide closed ends 521H (heel-side), 521T (toe-side) at locations spaced apart from the edges of the corresponding rail 542. In some embodiments, open ends 523 of slots 522 may be wider than closed ends 521, although this is not necessary.

In operation, when a user exerts a heel-side force on foot-retainer 518, heel-side slots 522H may be compressed to facilitate relative movement of heel-side legs 562 toward rider support surface 15 of board 10. Such movement of heel-side legs 562 and corresponding compression of heel-side slots 522H may also reduce the sizes (e.g. widths) of openings 523H of slots 522H and may involve compressing heel-side pads 19H. At the same time, toe-side slots 522T may be expanded such to facilitate relative movement of toe-side legs 564 away from rider support surface 15 of board 10. Such movement of toe-side legs 564 and corresponding expansion of toe-side slots 522T may also increase the sizes (e.g. widths) of openings 523T of slots 522T and may involve expansion of toe-side pads 19T. Conversely when a user exerts a toe-side force on foot-retainer 518, toe-side slots 522T may be compressed to facilitate relative movement of toe-side legs 564 toward rider support surface 15 of board 10. Such movement of toe-side legs 564 and corresponding compression of toe-side slots 522T may also reduce the sizes (e.g. widths) of openings 523T of slots 522T and may involve compressing toe-side pads 19T. At the same time, heel-side slots 522H may be expanded to facilitate relative movement of heel-side legs 562 away from rider support surface 15 of board 10. Such movement of heel-side legs 562 and corresponding expansion of heel-side slots 522H may also increase the sizes (e.g. widths) of openings 523H of slots 522H and may involve expansion of heel-side pads 19H. It will be appreciated that compression of heel-side slots 522H need not be associated with a commensurate level of expansion (or any expansion) of toe-side slots 522T and vice versa. This is particularly, the case where heel-side legs 562, toe-side legs 564 and/or central rail portions 566 have different levels of deformability, as discussed below.

In some embodiments, deformation-enhancing features 520 may be provided by other features (e.g. in addition to or in the alternative to slots 522). In one non-limiting example, deformation-enhancing features 520 may comprise regions of rails 542 having different levels of deformability. For example, deformation-enhancing features 520 may comprise deformation-enhancing members which are relatively deformable in comparison to the rest of rails 542 (e.g. heel-side legs 562, toe-side legs 564 and central rail portions 566). As another example, heel-side legs 562 and toe-side legs 564 may be relatively more deformable than central rail portions 566 or vice versa. Different levels of deformability may be provided by different materials, different rail thicknesses and/or different rigidity-enhancing rail features, such as ribs 568. In the illustrated embodiment, rails 542 comprise optional ribs 568. It can be seen from FIG. 9A, that the density of ribs 568 is relatively high in central rail portions 566 and relatively low in heel-side legs 562 and toe-side legs 564. Since higher density of ribs 568 is associated with increased rigidity, heel-side legs 562 and toe-side legs 564 may be relatively more deformable than central rail portions 566. A similar effect could be provided by rib thickness in addition to, or in the alternative to, rib density.

Foot-retainer 518, and in particular legs 562, 564 may be formed of a relatively soft or deformable plastic material to provide deformation-enhancing features 520. Such plastics may include high-density polyethylene, low-density polyethylene, nylon, etc. In some embodiments, other materials such as rubber and composite materials may be used. While the illustrated embodiment of foot-retainer 518 is integrally formed, in other embodiments at least central portion 566 and legs 562, 564 may be separately formed and coupled together to form foot-retainer 518. In particular embodiments, central portion 566 may be formed of a rigid material while legs 562, 564 may be formed of a relatively soft or deformable material. Available materials for forming foot-retainers are known in the art. In some embodiments, slots 522 may optionally be filled with a deformable material, such as a resiliently deformable material or a flexible material. This may make binding 512 easier to maintain by reducing the areas in which debris such as dirt or snow may be collected during use.

In the illustrated embodiment of FIGS. 9A and 9B, binding 512 comprises a base 515 which may be mounted to board 10 and which may comprise a foot-receiving surface 515A which receives a rider's foot thereupon. Base 515 (best shown in FIG. 9B) or portions thereof may be made of a material that is relatively deformable in comparison to rails 542, although this is not necessary. In one particular embodiment, an undersurface of base 515 may comprise a gasket fabricated from flexible material (e.g. rubber or soft plastic) which may enhance the ability of binding 512 to deform relative to board 10. Such a gasket may protect the rider support surface 15 of board 10. Such a gasket may be separate from the rest of base 515, integrally formed with the rest of base 515 or may be adhered to base 515 with suitable adhesive(s) or fastener(s).

In the FIG. 9B embodiment, base 515 comprises a circular cutout 528 which is analogous to cutout 28 described above (FIG. 2A) and base 515 is mounted to board 10 using a mounting disk similar to mounting disk 32 described above (FIG. 3). This is not necessary, however, and base 515 could be mounted to board 10 using any suitable technique. In the illustrated FIG. 9B embodiment, base 515 is integrally formed with central rail portions 566. This is not necessary. In other embodiments, base 515 could be coupled to central rail portions 566 using suitable couplers. For example, base 515 could be provided with stand-off flanges similar to those described herein which could be coupled to central rail portions 566 using movement joints of the types described herein or by more conventional fasteners.

Figure 9C:
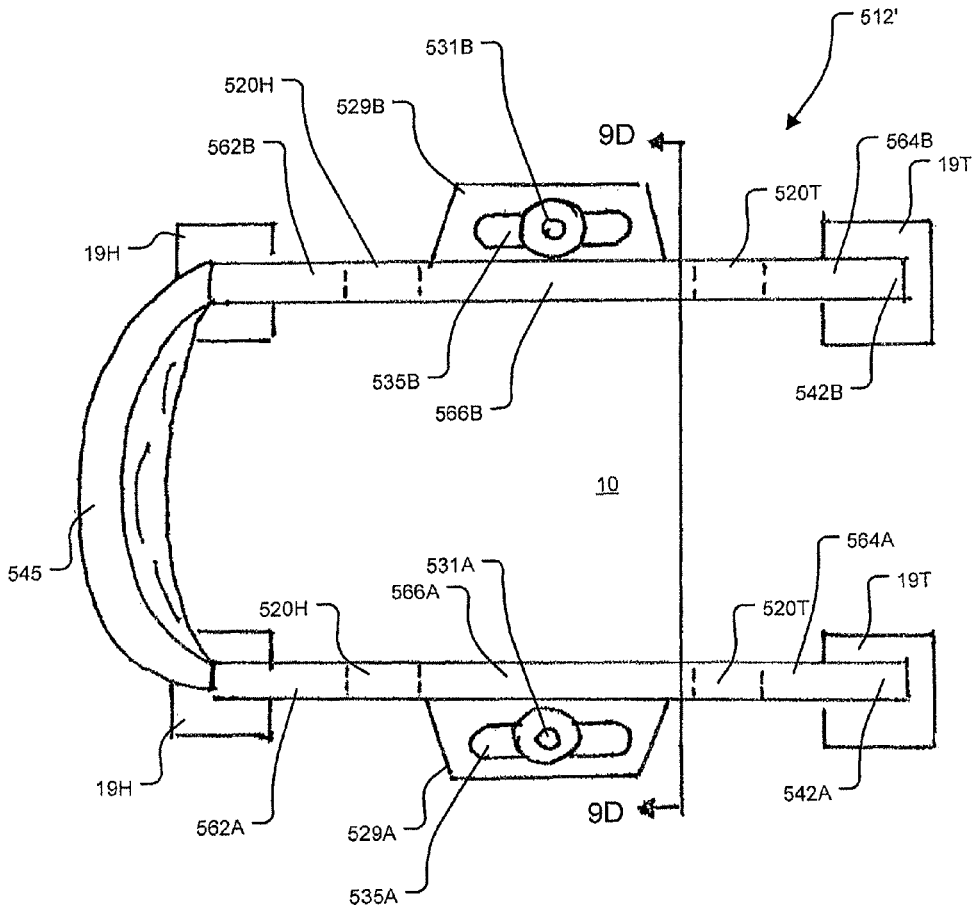
FIGS. 9C and 9D respectively show a top plan view and a toe-side cross-sectional view (along line 9D-9D) of a binding system according to another embodiment with the strapping system removed for clarity.
Figure 9D:
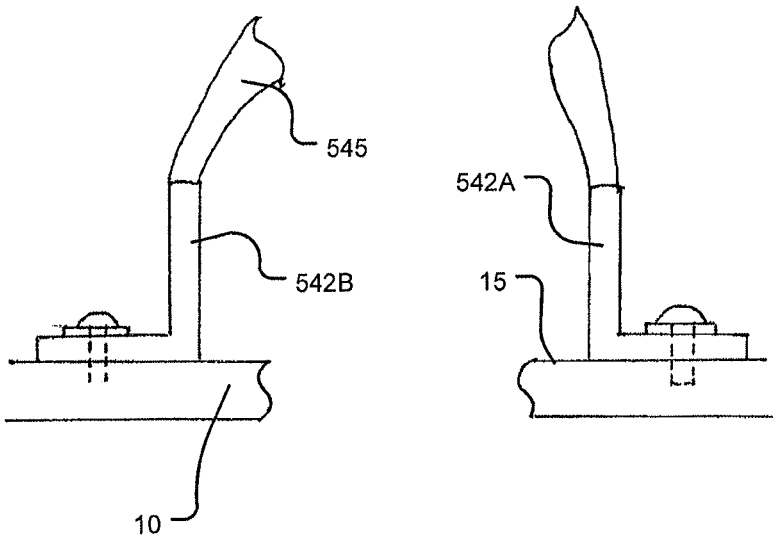

FIGS. 9C and 9D respectively show a top plan view and a toe-side cross-sectional view (along line 9D-9D) of a binding system 512' according to another embodiment with the strapping system removed for clarity. Binding system 512' is suitable for use with recreational board 10 (FIG. 1). Binding system 512' is similar in many respects to binding system 512 described above. Binding system 512' comprises a foot-retainer 518 (including rails 542 (legs 562, 564, central rail portions 566 and deformation-enhancing features 520), heel cup 545, strapping system (not shown) and pads 19T, 19H), which is substantially similar to foot-retainer 518 of binding system 512 described above.

Binding system 512' differs from binding system 512 in that binding system 512' does not include a base. Instead, rider support surface 15 of board 10 provides the foot-receiving surface for binding system 512' and central rail portions 566 are provided with mounting flanges 529A, 529B (collectively, mounting flanges 529) which are analogous to mounting flanges 29' described above (FIGS. 7A, 7B). Fasteners 531A, 531B project through apertures 535A, 535 in mounting flanges 529 (in a manner analogous to fasteners 31' projecting through apertures 35' in mounting flanges 29' described above) to mount central rail portions 566 of rails 542 to board 10. In the illustrated embodiment, central rail portions 566 are integrally formed with mounting flanges 529. This is not necessary. In other embodiments, mounting flanges 529 could be coupled to central rail portions 566 using suitable couplers. For example, mounting flanges 529 could be provided with stand-off flanges similar to those described herein (see stand-off flanges 26' described above (FIGS. 7A, 7B) which could be coupled to central rail portions 566 using movement joints of the types described herein or using more conventional fasteners.

Figure 10:
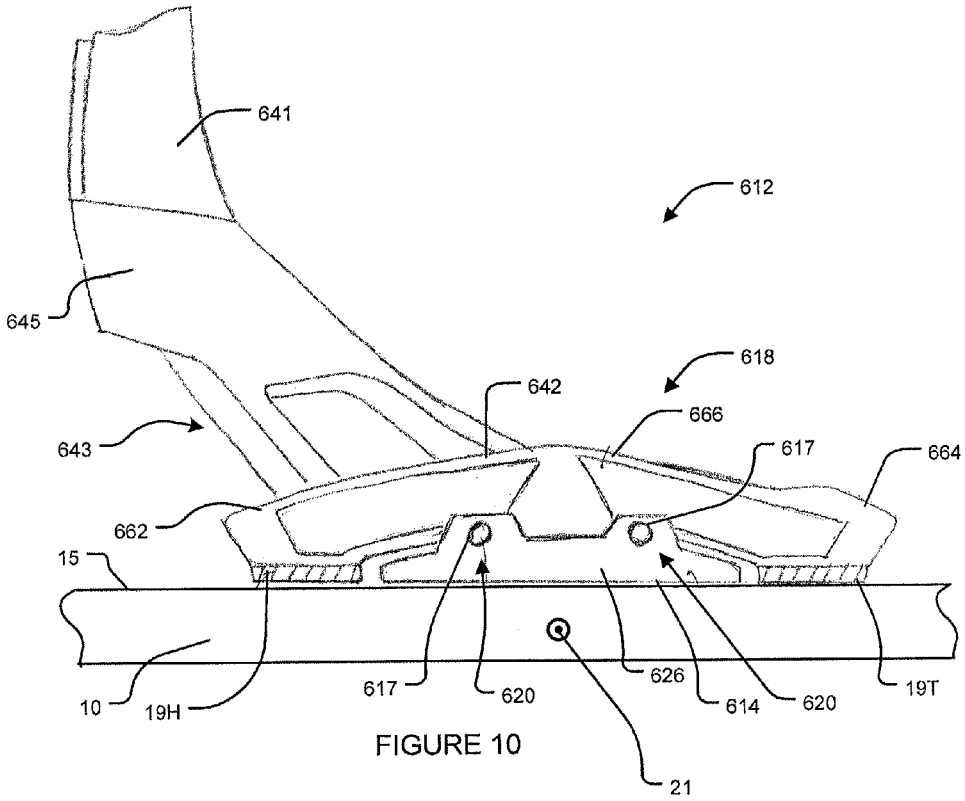
FIG. 10 is a rear plan view of a binding system according to another embodiment of the invention with the strapping system removed for clarity.

FIG. 10 is a rear plan view of a binding system 612 according to another embodiment of the invention with the strapping system removed for clarity. Binding system 612 is suitable for use with recreational board 10 (FIG. 1). In some respects, binding system 612 is similar to binding system 12 described above. More particularly, binding system 612 comprises a foot-retainer 618 for retaining a rider's foot in a manner similar to binding system 12 described above.

In the FIG. 10 embodiment, foot-retainer 618 comprises a heel cup 645 which defines a heel-side aperture 643, a pair of rails 642 which extend across longitudinal axis 21 of board 10 (e.g. from heel cup 645 toward toe-edge 24B of board 10), a high back 641 and a strapping system (not shown in the illustrated view). In the illustrated embodiment, rails 642 comprise heel-side legs 662, toe-side legs 664 and central rail portions 666. Binding system 612 also comprises optional pads 19H between heel-side legs 662 and rider-support surface 15 of board 10 and pads 19T between toe-side legs 664 and rider-support surface 15 of board 10. Binding system 612 also comprises a base 614 which may be rigidly mounted to board 10. Base 614 comprises stand-off flanges 626 that extend upwardly from rider-support surface 15 of board 10.

Binding system 612 of the illustrated FIG. 10 embodiment differs from binding system 12 described above in that binding system 612 comprises a plurality of connections 617 between central rail portions 666 and stand-off flanges 626. In some embodiments, one or more of connections 617 could comprise a movement joint 620 incorporating an elastically deformable bushing similar to movement joints 120 (FIGS. 6A-6D) and/or movement joints 220 (FIGS. 6E-6F) described above. This is not necessary however. In some embodiments, connections 617 could comprise more conventional fasteners. In some embodiments, different numbers of connections 617 (e.g. one connection 617 or a plurality of a different number of connections 617) could be provided between central rail portions 666 and stand-off flanges 626.

Binding system 612 also differs from binding system 12 in that rails 642 may be relatively rigid in comparison to stand-off flanges 626. As discussed above in relation to rails 542 of binding system 512, different levels of deformability may be provided by different materials, different component thicknesses and/or different rigidity-enhancing features, such as rib densities. In one particular embodiment, rails 642 are formed from relatively rigid material (e.g. hard plastic or metal) and stand-off flanges 626 are formed from a relatively deformable plastic or rubberized material.

When a user exerts a heel-side force on foot-retainer 618, heel-side leg 662 may move toward rider support surface 15, compressing heel-side pad 19H. This heel-side force may also cause center rail portion 666 to compress flange 626 by way of connections 617 (and/or to compress connections 617 when connections 617 comprise movement joints). Because flange 626 is relatively softer or more elastically deformable than foot-retainer 618 (including rails 642), flange 626 may deform, allowing further range of motion of heel-side leg 662.

Conversely, when a user exerts a toe-side force on foot-retainer 618, toe-side leg 662 may move toward rider support surface 15, compressing toe-side pad 19T. This toe-side force may also cause center rail portion 666 to compress flange 626 by way of connections 617 (and/or to compress connections 617 when connections 617 comprise movement joints). Flange 626 may deform, allowing further range of motion of toe-side leg 664. Preferably, flange 626 is formed of an elastically deformable material.

In some embodiments, stand-off flanges 626 may be provided in a base-less format using mounting flanges, apertures and suitable fasteners analogous to those described above in FIGS. 7A and 7B—i.e. where rider support surface 15 of board 10 provides the foot-receiving surface. In some embodiments, rails 642 may be configured to be relatively more deformable than standoffs 626. Such relative deformability of rails 642 relative to standoffs 626 may be provided in a manner similar to that discussed above—e.g. by different materials, different component thicknesses and/or different rigidity-enhancing features, such as rib densities.

Figure 11:
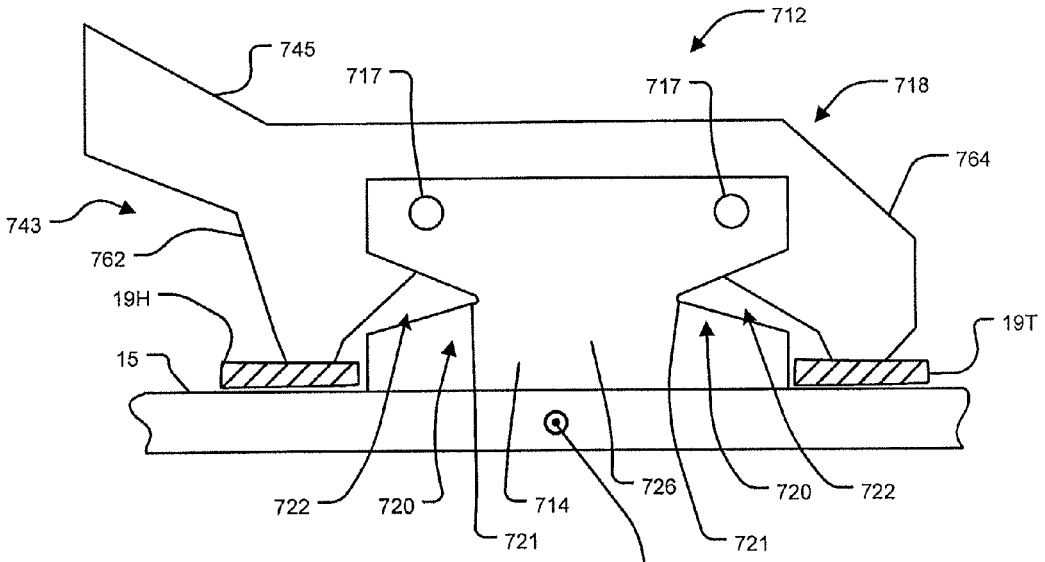
FIG. 11 is a rear plan view of a binding system according to another embodiment of the invention with the strapping system removed for clarity.

FIG. 11 is a rear plan view of a binding system 712 according to another embodiment of the invention with the strapping system removed for clarity. Binding system 712 is suitable for use with recreational board 10 (FIG. 1). Binding system 712 is generally similar to binding system 612 described above. More particularly, binding system 712 comprises a foot-retainer 718 for retaining a rider's foot in a manner similar to that of binding system 612. In the FIG. 11 embodiment, foot-retainer 718 comprises a heel cup 745 which defines a heel-side aperture 743, a pair of rails 742 which extend across longitudinal axis 21 of board 10 (e.g. from heel cup 745 toward the toe-side of board 10), a high back 741 and a strapping system (not shown in the illustrated view). In the illustrated embodiment, rails 742 comprise heel-side legs 762, toe-side legs 764 and central rail portions 766. Binding system 712 also comprises optional pads 19H between heel-side legs 762 and rider-support surface 15 of board 10 and pads 19T between toe-side legs 764 and rider-support surface 15 of board 10. Binding system 712 also comprises a base 714 which may be rigidly mounted to board 10. Base 714 comprises stand-off flanges 726 that extend upwardly from rider-support surface 15 of board 10. Connections 717 between foot-retainer 718 (e.g. rails 742) and flanges 726 may be similar to connections 617 described above. In some embodiments, stand-off flanges 726 may be provided in a base-less format using mounting flanges, apertures and suitable fasteners analogous to those described above in FIGS. 7A and 7B.

Binding system 712 differs primarily from binding system 612 in that in addition to or in the alternative to providing standoffs 726 that are relatively more deformable than rails 742, standoffs 726 of binding system 712 comprise deformation-enhancing features 720 (e.g. slots 722) similar to deformation-enhancing features 520 described above (FIGS. 9A and 9B).

While binding system 512 of FIGS. 9A-9D comprises deformation-enhancing features 520 in the foot-retainer 518 (e.g. in rails 542) and binding system 712 of FIG. 11 comprises deformation-enhancing features 720 in the base 714 (e.g. stand-off flanges 726), deformation-enhancing features may be provided in the base (including stand-off flanges in base-less embodiments) and/or the foot-retainer. For example, heel-side deformation-enhancing features may be provided in the foot-retainer while toe-side deformation-enhancing features may be provided in the standoffs or vice versa. Other combinations of movement joints between the foot-retainer and the base are possible. Additionally, in some embodiments the heel-side deformation-enhancing features and toe-side deformation-enhancing features may provide for different ranges of motion. Deformation-enhancing features having different ranges of motion between heel and toe side may allow a binding to be tailored to a rider's needs.

As will be apparent to those skilled in the art in the light of the foregoing disclosure, many alterations and modifications are possible in the practice of this invention without departing from the spirit or scope thereof. For example:

The binding systems described herein incorporate a number of features which are similar to those of particular prior art snowboard bindings. There are a wide variety of snowboard bindings. Suitable modifications to the bindings described herein may be made to accommodate components of other types of snowboard binding systems.

While particularly suited for snowboard bindings, the binding systems described herein are not limited to the particular application where the recreational board is a snowboard and the bindings are snowboard bindings. Those skilled in the art will appreciate that the innovative binding systems of the present invention may be used in a variety of other sports or activities where a rider's feet are retained by bindings to a rider-support surface of a recreational board in such a manner that the toes of a rider's foot are retained on one side of the longitudinal axis of the board and the heel of the rider's foot is retained on the opposing side of the longitudinal axis. By way of non-limiting example, the binding systems of the present invention may be used to provide bindings for surfboards, windsurf boards, wakeboards, sky surfing boards, kitesurfing boards or the like. Suitable modifications may be made to the embodiments described herein to provide binding systems for other recreational boards.

In the illustrated embodiment of FIGS. 1-5B, binding base 14 comprises stand-off flanges 26 which extend upwardly from base plate 24 to locate pivot couplings 20 in locations spaced upwardly apart from rider-support surface 15. This is not necessary. In some embodiments, the thickness of base plate 24, the desired range of pivotal motion about pivot axis 22 and/or the desired spacing of pivot axis 22 away from rider-support surface 15 of board 10 may be such that it is possible to accommodate pivot couplings 20 in base plate 24. Such embodiments may not include stand-off flanges 26.

In the illustrated embodiment of FIGS. 1-5B, stand-off flanges 26 are generally planar and extend upwardly from base plate 24 of base 14. This is not necessary. In some embodiments, it may be desirable to provide stand-off flanges 26 with contoured shapes which may help to accommodate the rider's foot.

In the illustrated embodiment of FIGS. 1-5B, stand-off flanges 26 are located closer to the rider's foot than (i.e. inside of) corresponding rails 42. This is not necessary. In some embodiments, base 14 may be designed such that one or both of stand-off flanges 26 are located further from the rider's foot than (i.e. outside of) corresponding rails 42. In still other embodiments, stand-off flanges 26 may be provided with a U-shape or some other shape that provides an upwardly opening groove and rails 42 may fit into the upwardly opening groove, such that stand-off flanges 26 are effectively inside and outside of rails 42.

In some embodiments, heel retainer 40 of foot-retainer 18 is not required. For example, in some embodiments, the combination of strapping system 47 and rails 42 is sufficient to permit the rider to operate binding 12 and board 10 as described above without using heel retainer 40. In some embodiments, heel retainer 40 may be provided separately from the rest of foot-retainer 18. Similarly, in some embodiments, high back portion 41 of heel retainer 40 is not required. For example, in some embodiments, the combination of strapping system 47, rails 42 and a low-rise heel retainer 40 is sufficient to permit the rider to operate binding 12 and board 10 as described above.

Binding 12 in the embodiment of FIGS. 1-5B makes use of strapping system 47 to retain the rider's foot between rails 42. In other embodiments (e.g. where a rider wears relatively stiff footwear, such as a hard-shell boot or the like), strapping system 47 may be modified and/or replaced to provide a so-called "step-in" binding system. In such embodiments, a step-in binding system may be rigidly coupled to (or integrally formed with) foot-retainer 18 (e.g. rails 42) and interacts with the user's footwear to retain the rider's foot in relation to foot-retainer 18. For example, such step-in binding systems may interact with heel welts and/or toe welts of hard-shell boots to retain the rider's foot relative to foot-retainer 18.

In the illustrated embodiment of FIGS. 1-5B, rails 42A and 42B are connected to one another at heel retainer 40 (i.e. on the heel side of heel side legs 62), but are not connected to one another between heel side legs 62 and toe side legs 64. In some embodiments, rails 42A, 42B may be connected to one another by a heel-side brace which extends between rails 42A, 42B in a vicinity of heel-side legs 62. In such embodiments, heel-side pads 19A, 19B may be replaced by a single heel-side pad which extends under the heel-side brace. Such a heel-side brace may provide binding 12 with additional torsional rigidity. In some embodiments, rails 42A, 42B may be connected to one another by a toe-side brace which extends between rails 42A, 42B in a vicinity of toe-side legs 64. In such embodiments, toe-side pads 19C, 19D may be replaced by a single toe-side pad which extends under the toe-side brace. Again, such a toe-side brace may provide binding 12 with additional torsional rigidity.

In some embodiments, pivot couplings 20 between rails 42 and stand-off flanges 26 may be provided with one or more deformable bushings which may serve to dampen or otherwise cushion the pivotal motion of foot-retainer 18 relative to base 14 and/or board 10. By way of non-limiting example, in some embodiments, apertures 38 could be transversely elongated (in a manner similar to apertures 44) and a bushing could be provided to extend between apertures 38, 44 at the transverse extremes of apertures 38, 44. In such embodiments, pivotal motion toward heel edge 24A would involve compression of the heel-side bushing and pivotal motion of foot-retainer 18 toward toe edge 24B would involve compression of the toe-side bushing. In other embodiments, pivot joints 20 may be provided with other suitable dampening mechanisms. The deformable bushings of some other embodiments may serve to dampen or otherwise cushion the non-pivotal motion of the foot-retainer relative to the base and/or relative to the board.

Referring to FIG. 1, it may be seen that in the illustrated embodiment of FIGS. 1-5B, pivot axis 22 is slightly skewed relative to longitudinal axis 21 of board 10. In general, the angle of this skew between pivot axis 22 and longitudinal axis 21 will depend on the orientation of binding 12 relative to board 10 which may be rider-adjustable as discussed above. For most riders, the angle of this skew between pivot axis 22 and longitudinal axis 21 is in a range of 0° to 45°. In some embodiments, this angle is in a range of 0° to 28°. In general, the rearward binding (not shown) may be oriented at a different angle relative to board 10, such that skew angle between the pivot axis of the rearward binding and longitudinal axis 21 is different than the skew angle for forward binding 12. For most riders, the angle of the skew between the pivot axis of the rearward binding 12 and longitudinal axis 21 is in a range of −45° to 45°. In some embodiments, this angle is in a range of −28° to 28°

In some embodiments, it may be desirable to have pivot axis 22 align more closely to longitudinal axis 21. This alignment may be achieved by orienting pivot couplings 20 in alignment with (or in relatively closer alignment with) longitudinal axis 21 in any suitable manner. It may be desirable to allow a rider to achieve this angular orientation of pivot axis 22 without changing (or without substantially changing) the stance angle of the rider's feet have with board 10. The stance angle may refer to the orientation of the bindings relative to board 10 about a vertically extending axis. Such angular orientations of pivot axis 22 may be achieved using a wide variety of techniques. By way of non-limiting example, one or more wedge-shaped (and optionally elastically deformable) spacers may be used on either (or both) sides of apertures 38, 44 (or between apertures 38, 44) to provide the desired angular offset, pivot couplings 20 may be provided with suitably skewed flanges 74, 76 to provide the desired angular offset, specialized pivot couplings 20 which incorporate an angular skew may be used to provide the desired offset, rails 42 may be provided with suitably angled (e.g. wedge shaped) cross-sections to provide the desired angular offset or the like.

In the illustrated embodiment of FIGS. 1-5B, rails 42 are symmetrical and have the same length. These features are not necessary. In some embodiments, rails 42 may be asymmetrical. Rails 42 may be shaped (e.g. contoured) to fit more closely to the rider's feet. In some embodiments, rails 42 may have different lengths. The length of each rail 42 may depend on the stance angle of rider (i.e. the angular orientation of bindings 12 with respect to longitudinal axis 21. In one particular embodiment, the length of each rail 42 is selected such that legs 62 and/or legs 64 are aligned along lines that are generally parallel to longitudinal axis 21.

In some of the embodiments described herein, the heel cup is described as being integrally formed with other parts of the bindings (e.g. the rails). This is not necessary. In any of the embodiments described herein which include heel cups, such heel cups may be connected to other parts of the bindings (e.g. the rails) using suitable fasteners.

What is claimed is:

1. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board wherein, for at least one of the rails, the at least one deformation-enhancing feature comprises a heel-side deformation-enhancing feature located between the heel-side leg and the central portion for enhancing an ability of the heel-side leg to deform elastically relative to the central portion.

2. A binding system according to claim 1 wherein, for the at least one of the rails, the at least one deformation-enhancing feature comprises a toe-side deformation-enhancing feature located between the toe-side leg and the central portion for enhancing an ability of the toe-side leg to deform elastically relative to the central portion.

3. A binding system according to claim 1 wherein, for the at least one of the rails, the heel-side deformation-enhancing feature comprises a heel-side cut-away slot which extends inwardly from an edge of the at least one of the rails between the heel-side leg and the central portion.

4. A binding system according to claim 3 wherein the slot has an opening located at an end of the slot most proximate the edge of the at least one of the rails and wherein elastic deformation of the heel-side leg relative to the central portion comprises at least one of increasing a size of the opening and decreasing the size of the opening.

5. A binding system according to claim 4 wherein the slot is shaped to provide the opening at a lower edge of the at least one of the rails.

6. A binding system according to claim 1 wherein, for the at least one of the rails, the heel-side deformation-enhancing feature comprises a heel-side deformation member, the heel-side deformation member relatively more deformable than the heel-side leg and the central portion.

7. A binding system according to claim 6 wherein the heel-side deformation member is fabricated from a material that is relatively more deformable than the heel-side leg and the central portion.

8. A binding system according to claim 6 wherein the central portion and the heel-side leg each comprise a plurality of stiffening ribs and the heel-side deformation member comprises a lower density of stiffening ribs relative to the central portion and the heel-side leg.

9. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board wherein, for at least one of the rails, the at least one deformation-enhancing feature comprises a toe-side deformation-enhancing feature located between the toe-side leg and the central portion for enhancing an ability of the toe-side leg to deform elastically relative to the central portion.

10. A binding system according to claim 9 wherein, for the at least one of the rails, the toe-side deformation-enhancing feature comprises a toe-side cut-away slot which extends inwardly from an edge of the at least one of the rails between the toe-side leg and the central portion.

11. A binding system according to claim 10 wherein the slot has an opening located at an end of the slot most proximate the edge of the at least one of the rails and wherein elastic deformation of the toe-side leg relative to the central portion comprises at least one of increasing a size of the opening and decreasing the size of the opening.

12. A binding system according to claim 11 wherein the slot is shaped to provide the opening at a lower edge of the at least one of the rails.

13. A binding system according to claim 9 wherein, for the at least one of the rails, the toe-side deformation-enhancing feature comprises a toe-side deformation member, the toe-side deformation member relatively more deformable than the toe-side leg and the central portion.

14. A binding system according to claim 13 wherein the toe-side deformation member is fabricated from a material that is relatively more deformable than the toe-side leg and the central portion.

15. A binding system according to claim 13 wherein the central portion and the toe-side leg each comprise a plurality of stiffening ribs and the toe-side deformation member comprises a lower density of stiffening ribs relative to the central portion and the toe-side leg.

16. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board;

wherein, for at least one of the rails, the at least one deformation-enhancing feature enhances an ability of at least one of the toe-side leg and the heel-side leg to deform elastically relative to the central portion and the at least one deformation-enhancing feature comprises the heel-side leg being relatively more deformable than the central portion; and wherein the central portion comprises a plurality of stiffening ribs and the heel-side leg comprises a lower density of stiffening ribs relative to the central portion, thereby making the heel-side leg relatively more deformable than the central portion.

17. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board;

wherein, for at least one of the rails, the at least one deformation-enhancing feature enhances an ability of at least one of the toe-side leg and the heel-side leg to deform elastically relative to the central portion and the at least one deformation-enhancing feature comprises the heel-side leg being relatively more deformable than the central portion; and wherein the heel-side leg is fabricated from a material that is relatively more deformable than the central portion.

18. A binding system for retaining a rider's foot atop a recreational board, the binding system comprising:

a base mountable to the recreational board, the base comprising a front stand-off flange located forwardly of a generally flattened foot-receiving surface for receiving a rider's foot and a rear stand-off flange located rearwardly of the foot-receiving surface; and a foot retainer for retaining the rider's foot in generally fixed relation thereto, the foot-retainer comprising a front rail located forwardly of the foot-receiving surface and connected to the front stand-off flange at one or more front connections and a rear rail located rearwardly of the foot-receiving surface and connected to the rear stand-off flange at one or more rear connections;

wherein one of:

(a) the front rail is relatively more deformable than the front stand-off flange and the rear rail is relatively more deformable than the rear stand-off flange for motion of the rider's foot relative to the recreational board by deformation of one or both of the front and rear rails; and (b) the front standoff flange is relatively more deformable than the front rail and the rear stand-off flange is relatively more deformable than the rear rail for motion of the rider's foot relative to the recreational board by deformation of one or both of the front and rear stand-off flanges;

wherein, each of the one or more front connections comprises a shaft that extends between the front rail and the front stand-off flange through a bore of one or more deformable bushings, the one or more deformable bushings more deformable than both the front stand-off flange and the front rail and wherein motion of the rider's foot relative to the recreational board is associated with corresponding movement of the shaft.

19. A binding system for retaining a rider's foot atop a recreational board, the binding system comprising:

a base rigidly mountable to the recreational board, the base comprising a front stand-off flange located forwardly of a generally flattened foot-receiving surface for receiving a rider's foot thereupon and a rear stand-off flange located rearwardly of the foot-receiving surface; and a foot-retainer for retaining the rider's foot in generally fixed relation thereto, the foot-retainer comprising a front rail located forwardly of the foot-receiving surface and moveably coupled to the front stand-off flange at a front movement joint and a rear rail located rearwardly of the foot-receiving surface and moveably coupled to the rear stand-off flange at a rear movement joint;

wherein the base and foot-retainer are shaped to retain the rider's foot on the foot-receiving surface such that the toes of the rider's foot are on a toe-side of a longitudinal axis of the board and the heel of the rider's foot are on a heel-side of the longitudinal axis, the heel-side and toe-side transversely opposing one another;

wherein the front movement joint and the rear movement joint facilitate motion of the foot-retainer and the rider's foot relative to the base and the recreational board.

20. A binding system according to claim 19 wherein the front movement joint and the rear movement joint are upwardly spaced apart from the foot-receiving surface.

21. A binding system according to claim 19 wherein the front movement joint and the rear movement joint respectively comprise front and rear pivot joints which facilitate pivot motion about a pivot axis located in a pivot plane, the pivot plate generally parallel to and spaced upwardly apart from the foot-receiving surface.

22. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board;

wherein, for at least one of the rails, the at least one deformation-enhancing feature enhances an ability of at least one of the toe-side leg and the heel-side leg to deform elastically relative to the central portion and the at least one deformation-enhancing feature comprises the toe-side leg being relatively more deformable than the central portion; and wherein the central portion comprises a plurality of stiffening ribs and the toe-side leg comprises a lower density of stiffening ribs relative to the central portion, thereby making the toe-side leg relatively more deformable than the central portion.

23. A binding system for retaining a rider's foot atop a recreational board, the binding system comprising:

a pair of rails locatable on opposing sides of a generally flattened foot-receiving surface for the rider's foot, each rail comprising a central portion mountable to the recreational board, a toe-side leg which extends from the central portion toward a toe-side of the recreational board and a heel-side leg which extends from the central portion toward a heel-side of the recreational board, the heel-side and the toe-side located on transversely opposite sides of a longitudinal axis of the board; and each rail comprising at least one deformation-enhancing feature for enhancing an ability of the rail to deform elastically relative to the board;

wherein, for at least one of the rails, the at least one deformation-enhancing feature enhances an ability of at least one of the toe-side leg and the heel-side leg to deform elastically relative to the central portion and the at least one deformation-enhancing feature comprises the toe-side leg being relatively more deformable than the central portion; and wherein the toe-side leg is fabricated from a material that is relatively more deformable than the central portion.

* * * * *